US007986294B2

(12) United States Patent
Kojima

(10) Patent No.: US 7,986,294 B2
(45) Date of Patent: Jul. 26, 2011

(54) METHOD OF ADJUSTING A PULSE-WIDTH MODULATION CLOCK

(75) Inventor: Kazuo Kojima, Kanagawa (JP)

(73) Assignee: Sony Corporation, Tokyo (JP)

( * ) Notice: Subject to any disclaimer, the term of this patent is extended or adjusted under 35 U.S.C. 154(b) by 753 days.

(21) Appl. No.: 11/706,127

(22) Filed: Feb. 13, 2007

(65) Prior Publication Data

US 2007/0216638 A1 Sep. 20, 2007

(30) Foreign Application Priority Data

Mar. 3, 2006 (JP) ..... 2006-057982

(51) Int. Cl.
*G09G 3/36* (2006.01)

(52) U.S. Cl. ..... 345/102

(58) Field of Classification Search ..... 345/102, 345/87, 84, 55, 30, 33, 35, 38, 39, 77, 76
See application file for complete search history.

(56) References Cited

U.S. PATENT DOCUMENTS 6,771,281 B2 * 8/2004 Takagi ..... 345/690
7,126,397 B1 * 10/2006 Mok ..... 327/175
7,573,447 B2 * 8/2009 Oh et al. ..... 345/87
7,633,577 B2 * 12/2009 Moon et al. ..... 349/69
7,652,655 B2 * 1/2010 Kim ..... 345/102
2002/0000982 A1 * 1/2002 Takagi ..... 345/204
2005/0276080 A1 * 12/2005 Okada ..... 363/41
2006/0001641 A1 * 1/2006 Degwekar et al. ..... 345/102
2006/0066265 A1 * 3/2006 Plotz et al. ..... 315/291
2006/0152468 A1 * 7/2006 Ozaki ..... 345/102
2006/0221020 A1 * 10/2006 Winer et al. ..... 345/84
2007/0076019 A1 * 4/2007 Randall ..... 345/691
2007/0139449 A1 * 6/2007 Bergquist et al. ..... 345/691

FOREIGN PATENT DOCUMENTS

JP 11-109317 4/1999
JP 2005-017324 1/2005

* cited by examiner

*Primary Examiner* — Richard Hjerpe
*Assistant Examiner* — Jeffrey Parker
(74) *Attorney, Agent, or Firm* — Wolf, Greenfield & Sacks, P.C.

(57) ABSTRACT

A method for driving a planar light source device is provided. The planar light source device includes (a) a plurality of planar light source units to light a color LCD device from the back, each planar light source unit including a red LED, a green LED, and a blue LED; and (b) a driving circuit to perform ON/OFF control of the red LED, the green LED, and the blue LED included in each planar light source unit on the basis of pulse-width modulation. The method includes adjusting respective pulse-width modulation unit clocks $CL_{R\text{-}unit}$, $CL_{G\text{-}Unit}$, and $CL_{B\text{-}Unit}$ in each planar light source unit to long or short by increasing or decreasing the number of frequency division cycles of a system clock in the driving circuit.

8 Claims, 8 Drawing Sheets

METHOD OF ADJUSTING A PULSE-WIDTH MODULATION CLOCK

CROSS REFERENCES TO RELATED APPLICATIONS

The present invention contains subject matter related to Japanese Patent Application JP 2006-057982 filed in the Japanese Patent Office on Mar. 3, 2006, the entire contents of which are incorporated herein by reference.

BACKGROUND OF THE INVENTION

1. Field of the Invention

The present invention relates to a method for driving a planar light source device, a method for driving a color liquid crystal display (LCD) device assembly, a method for driving a light emitting diode (LED), and a pulse-width modulating method.

2. Description of the Related Art

In a color LCD device, liquid crystal itself emits no light. Thus, a planar light source device (backlight) is placed on a rear surface of the color LCD device so as to directly light the color LCD device. In the color LCD device, each pixel includes three sub-pixels: a red light emitting sub-pixel; a green light emitting sub-pixel; and a blue light emitting sub-pixel. By operating a liquid crystal cell constituting each sub-pixel as a kind of light shutter (light valve), that is, by controlling light transmittance of each sub-pixel, light transmittance of illuminating light (e.g., white light) emitted from the planar light source device is controlled, whereby an image is displayed.

Conventionally, a planar light source device in a color LCD display device assembly evenly lights an entire display area at constant luminance. Another planar light source device having a configuration different from that of the above-described planar light source device is known, as disclosed in Japanese Unexamined Patent Application Publication No. 2005-17324. This planar light source device includes a plurality of planar light source units, and distribution of illuminance varies in a plurality of display area units constituting the color LCD device. The planar light source device including a plurality of planar light source units may be called a "split-driven planar light source device" for convenience. Each of the planar light source units constituting the split-driven planar light source device disclosed in Japanese Unexamined Patent Application Publication No. 2005-17324 includes a red LED (light emitting diode), a green LED, and a blue LED. By mixing red light emitted from the red LED, green light emitted from the green LED, and blue light emitted from the blue LED, white light having a high chromatic purity can be obtained, and the white light is used as illuminating light.

The LED emits heat while being driven. Even under the same condition, variation occurs in a Vf characteristic as a result of heat emission, so that light output from the LED reduces. A reduction rate is different in the respective red, green, and blue LEDs. Particularly, light output from the red LED reduces significantly. This causes variation in a so-called white balance (color temperature) of white light, which is obtained as illuminating light by mixing light emitted from the red, green, and blue LEDs.

In the technique disclosed in Japanese Unexamined Patent Application Publication No. 2005-17324, the amount of driving current detected by a driving current detecting unit is fed back to a drive control unit. The amount of the fed back driving current is compared with a predetermined amount of current. On the basis of the comparison result, a drive control signal is changed so as to control the amount of light emitted from each of light emitting devices corresponding to three colors, whereby the white balance of a displayed image is controlled.

On the other hand, in the split-driven planar light source device, each of the planar light source units is controlled on the basis of the following method. This is disclosed in Japanese Unexamined Patent Application Publication No. 11-109317, for example. That is, maximum luminance in the planar light source unit is represented by $Y_{max}$, and a maximum value (specifically, 100%) of light transmittance (aperture ratio) of a liquid crystal cell constituting sub-pixels in a display area is represented by $Lt_{max}$. When the planar light source unit has the maximum luminance $Y_{max}$, light transmittance (aperture ratio) of a liquid crystal cell constituting a pixel to obtain luminance $y_0$ in a display area unit is represented by $Lt_0$. In this case, luminance of the planar light source unit (light source unit luminance $Y_0$) is controlled so that $y_0 \cdot Lt_0 = Y_0 \cdot Lt_{max}$ is satisfied. Thus, in a case where LEDS constituting the planar light source unit are driven in pulse-width modulation (PWM), pulse-width modulation control to obtain the light source unit luminance $Y_0$ may be performed. That is, in the pulse-width modulation, a pulse-width modulation unit clock is represented by $CL_{unit}$, an ON time is represented by $t_{ON}$, an OFF time is represented by $t_{OFF}$, and a value of a pulse-width modulation output signal is represented by S. In this case, when the light source unit luminance $Y_0$ is to be obtained, values S of three types of pulse-width modulation output signals for ON/OFF control of the red, green, and blue LEDs constituting the planar light source unit (a value $S_R$ of a pulse-width modulation output signal for ON/OFF control of the red LED, a value $S_G$ of a pulse-width modulation output signal for ON/OFF control of the green LED, and a value $S_B$ of a pulse-width modulation output signal for ON/OFF control of the blue LED) may be determined so that expressions "$t_{ON}+t_{OFF}$=constant value $t_{Const}$" and "$t_{ON}=CL_{unit} \times S$" are satisfied. The value of the pulse-width modulation unit clock $CL_{unit}$ is invariable.

SUMMARY OF THE INVENTION

For example, in a case where the value S of a pulse-width modulation output signal is controlled at 8 bits, the value S of the pulse-width modulation output signal is an integer in a range of 0 to 255. Now, assume that $S_R=S_G=S_B=3$, in order to obtain white light as illuminating light from the planar light source unit. Also, assume that drive of the red, green, and blue LEDs causes the respective LEDs to emit heat, particularly that the Vf characteristic of the red LED varies, that the light output therefrom significantly reduces, and that the white balance of the white light varies.

In this case, the value $S_R$ of the pulse-width modulation output signal for ON/OFF control of the red LED is increased. A minimum increase of the value $S_R$ of the pulse-width modulation output signal is "1". Thus, $S_R=4$ and $S_G=S_B=3$ are satisfied. That is, the ON time of the red LED is 1.3 times with respect to the ON time of the green and blue LEDs. Accordingly, a relatively large increase in the ON time of the red LED makes an appropriate adjustment of the white balance of white light difficult.

The present invention is directed to providing a pulse-width modulating method enabling a precise adjustment of characteristics (e.g., a Vf characteristic and a light output characteristic) even if characteristics of a device driven in pulse-width modulation (PWM) (e.g., a Vf characteristic and a light output characteristic of an LED) change over time, and also providing a method for driving a planar light source device, a method for driving a color LCD device assembly, and a method for driving an LED applying the pulse-width modulating method.

According to an embodiment of the present invention, there is provided a method for driving a planar light source device. The planar light source device includes (a) a plurality of planar light source units to light a color LCD device from the back, each planar light source unit including a red LED, a green LED, and-a blue LED; and (b) a driving circuit to perform ON/OFF control of the red LED, the green LED, and the blue LED included in each planar light source unit on the basis of pulse-width modulation. When pulse-width modulation unit clocks in the pulse-width modulation for ON/OFF control of the red, green, and blue LEDs included in each planar light source unit are $CL_{R\text{-}unit}$, $CL_{G\text{-}unit}$, and $CL_{B\text{-}Unit}$; when ON time of the red LED in each planar light source unit is $t_{R\text{-}ON}$; when OFF time of the red LED is $t_{R\text{-}OFF}$; when a value of a pulse-width modulation output signal to control light emission time of the red LED is $S_R$; when ON time of the green LED is $t_{G\text{-}ON}$; when OFF time of the green LED is $t_{G\text{-}OFF}$; when a value of a pulse-width modulation output signal to control light emission time of the green LED is $S_G$; when ON time of the blue LED is $t_{B\text{-}ON}$; when OFF time of the blue LED is $t_{B\text{-}OFF}$; and when a value of a pulse-width modulation output signal to control light emission time of the blue LED is $S_B$, $$t_{R\text{-}ON}+t_{R\text{-}OFF}=t_{G\text{-}ON}+t_{G\text{-}OFF}=t_{B\text{-}ON}+t_{B\text{-}OFF}=\text{constant value } t_{Const};$$

$$t_{R\text{-}ON}=CL_{R\text{-}unit}\times S_R \quad (1\text{-}1);$$

$$t_{G\text{-}ON}=CL_{G\text{-}unit}\times S_G \quad (1\text{-}2); \text{ and}$$

$t_{B\text{-}ON}=CL_{B\text{-}unit}\times S_B$ (1-3) are satisfied. The method includes the step of adjusting the respective pulse-width modulation unit clocks $CL_{R\text{-}unit}$, $CL_{G\text{-}unit}$, and $CL_{B\text{-}Unit}$ in each planar light source unit to long or short by increasing or decreasing the number of frequency division cycles of a system clock in the driving circuit.

According to another embodiment of the present invention, there is provided a method for driving a color LCD device assembly. The color LCD device assembly includes (a) a color LCD device including a display area having P×Q display area units, the display area including pixels arranged in a two-dimensional matrix pattern and each of the display area units including a plurality of pixels; (b) a planar light source device including P×Q planar light source units corresponding to the P×Q display area units and a driving circuit to drive the planar light source units, each planar light source unit including a red LED, a green LED, and a blue LED, and lighting the corresponding display area unit from the back; and (c) a color LCD device driving circuit to drive the color LCD device. When pulse-width modulation unit clocks in pulse-width modulation for ON/OFF control of the red, green, and blue LEDs included in each planar light source unit are $CL_{R\text{-}unit}$, $CL_{G\text{-}unit}$, and $CL_{B\text{-}unit}$; when ON time of the red LED in each planar light source unit is $t_{R\text{-}ON}$; when OFF time of the red LED is $t_{R\text{-}OFF}$; when a value of a pulse-width modulation output signal to control light emission time of the red LED is $S_R$; when ON time of the green LED is $t_{G\text{-}ON}$; when OFF time of the green LED is $t_{G\text{-}OFF}$; when a value of a pulse-width modulation output signal to control light emission time of the green LED is $S_G$; when ON time of the blue LED is $t_{B\text{-}ON}$; when OFF time of the blue LED is $t_{B\text{-}OFF}$; and when a value of a pulse-width modulation output signal to control light emission time of the blue LED is $S_B$, $$t_{R\text{-}ON}+t_{R\text{-}OFF}=t_{G\text{-}ON}+t_{G\text{-}OFF}=t_{B\text{-}ON}+t_{B\text{-}OFF}=\text{constant value } t_{Const};$$

$$t_{R\text{-}ON}=CL_{R\text{-}unit}\times S_R \quad (1\text{-}1);$$

$$t_{G\text{-}ON}=CL_{G\text{-}unit}\times S_G \quad (1\text{-}2); \text{ and}$$

$t_{B\text{-}ON}=CL_{B\text{-}unit}\times S_B$ (1-3) are satisfied. The method includes the step of adjusting the respective pulse-width modulation unit clocks $CL_{R\text{-}unit}$, $CL_{G\text{-}unit}$, and $CL_{B\text{-}unit}$ in each planar light source unit to long or short by increasing or decreasing the number of frequency division cycles of a system clock in the driving circuit.

In the above-described method for driving the planar light source device or method for driving the color LCD device assembly, $$t_{R\text{-}ON\text{-}max}<t_{Const};$$

$$t_{G\text{-}ON\text{-}max}<t_{Const}; \text{ and}$$

$t_{B\text{-}ON\text{-}max}<t_{Const}$ are preferably satisfied when maximum ON time of the red LED is $t_{R\text{-}ON\text{-}max}$; when maximum ON time of the green LED is $t_{G\text{-}ON\text{-}max}$; and when maximum ON time of the blue LED is $t_{B\text{-}ON\text{-}max}$. Accordingly, even if heat generation due to driving of the red, green and blue LEDs causes variation in the Vf characteristic of those LEDs and difference in output light, the variation and difference can be adjusted by adjusting the pulse-width modulation unit clocks $CL_{R\text{-}unit}$, $CL_{G\text{-}unit}$, and $CL_{B\text{-}unit}$ in each planar light source unit to long or short by increasing or decreasing the number of frequency division cycles of the system clock in the driving circuit, so that the length of the ON times $t_{R\text{-}ON}$, $t_{G\text{-}ON}$, and $t_{B\text{-}ON}$ can be controlled. In this case, start of operations of the LEDs can be reliably synchronized in the next light emission cycle.

Also, in the above-described method for driving the planar light source device or method for driving the color LCD device assembly, the respective pulse-width modulation unit clocks $CL_{R\text{-}unit}$, $CL_{G\text{-}unit}$, and $CL_{B\text{-}unit}$ in each planar light source unit are preferably adjusted to long or short by increasing or decreasing the number of frequency division cycles of the system clock in the driving circuit by one unit clock, by two unit clocks, or by three unit clocks.

Furthermore, in the above-described method for driving the planar light source device or method for driving the color LCD device assembly, luminance of each of the red, green, and blue LEDs included in each planar light source unit is measured, and the number of frequency division cycles of the system clock in the driving circuit is desirably increased or decreased on the basis of a measurement result of the luminance. The luminance of the LEDs can be measured by using a known optical sensor, such as a photodiode or a CCD device.

According to another embodiment of the present invention, there is provided a method for driving an LED. A driving circuit to perform ON/OFF control of the LED on the basis of pulse-width modulation is used. When a pulse-width modulation unit clock in the pulse-width modulation for ON/OFF control of the LED is $CL_{unit}$; when ON time of the LED is $t_{ON}$; when OFF time of the LED is $t_{OFF}$; and when a value of a pulse-width modulation output signal to control light emission time of the LED is S, $$t_{ON}+t_{OFF}=\text{constant value } t_{Const}; \text{ and}$$

$t_{ON}=CL_{unit}\times S$ (1) are satisfied. The method includes the step of adjusting the pulse-width modulation unit clock $CL_{unit}$ to long or short by increasing or decreasing the number of frequency division cycles of a system clock in the driving circuit.

In the above-described method for driving the LED, when maximum ON time of the LED is $t_{ON-max}$, $t_{ON-max}<t_{Const}$ is preferably satisfied. The pulse-width modulation unit clock $CL_{unit}$ is preferably adjusted to long or short by increasing or decreasing the number of frequency division cycles of the system clock in the driving circuit by one unit clock, by two unit clocks, or by three unit clocks. Alternatively, luminance of the LED is measured, and the number of frequency division cycles of the system clock in the driving circuit is desirably increased or decreased on the basis of a measurement result of the luminance. The luminance of the LED can be measured by using a known optical sensor, such as a photodiode or a CCD device.

According to another embodiment of the present invention, there is provided a pulse-width modulating method. When a pulse-width modulation unit clock in pulse-width modulation is $CL_{unit}$; when ON time is $t_{ON}$; when OFF time is $t_{OFF}$; and when a value of a pulse-width modulation output signal is S, $t_{ON}+t_{OFF}$=constant value $t_{Const}$; and $t_{ON}=CL_{unit}\times S$ (1) are satisfied. The method includes the step of adjusting the pulse-width modulation unit clock $CL_{unit}$ to long or short by increasing or decreasing the number of frequency division cycles of a system clock in the pulse-width modulation.

In the pulse-width modulating method, $t_{ON-max}<t_{Const}$ is preferably satisfied when a maximum ON time is $t_{ON-max}$. Also, the pulse-width modulation unit clock $CL_{unit}$ is preferably adjusted to long or short by increasing the number of frequency division cycles of the system clock in the pulse-width modulation by one unit clock, by two unit clocks, or by three unit clocks, or by decreasing the number by one unit clock, by two unit clocks, or by three unit clocks.

In the method for driving the color LCD device assembly, each pixel includes a set of three sub-pixels: a red light emitting sub-pixel; a green light emitting sub-pixel; and a blue light emitting sub-pixel. The color LCD device driving circuit supplies a red light emission control signal to control light transmittance of the red light emitting sub-pixel; a green light emission control signal to control light transmittance of the green light emitting sub-pixel; and a blue light emission control signal to control light transmittance of the blue light emitting sub-pixel to the red light emitting sub-pixel, the green light emitting sub-pixel, and the blue light emitting sub-pixel included in each pixel, respectively. The luminance of the planar light source units corresponding to the respective display area units is desirably increased or decreased under control by the driving circuit so that the luminance of pixels under an assumed condition can be obtained. The assumed condition is that a red light emission control signal, a green light emission control signal, and a blue light emission control signal corresponding to a red light emitting sub-pixel driving signal, a green light emitting sub-pixel driving signal, and a blue light emitting sub-pixel driving signal having values equal to a maximum value $x_{U-max(R,G,B)}$ among a value $x_R$ of the red right emitting sub-pixel driving signal, a value $x_G$ of the green right emitting sub-pixel driving signal, and a value $x_B$ of the blue light emitting sub-pixel driving signal input to the color LCD device driving circuit in order to drive the red light emitting sub-pixel, the green light emitting sub-pixel, and the blue light emitting sub-pixel in every pixel constituting each display area unit are supplied to the red light emitting sub-pixel, the green light emitting sub-pixel, and the blue light emitting sub-pixel.

On the basis of the red light emitting sub-pixel driving signal (value $x_R$), the green light emitting sub-pixel driving signal (value $x_G$), and the blue light emitting sub-pixel driving signal (value $x_B$), more specifically, on the basis of the maximum value $x_{U-max(R,G,B)}$, values $S_R$, $S_G$, and $S_B$ of pulse-width modulation output signals to control light emission time of the red LED, green LED, and blue LED are generated in the diving circuit.

Herein, the values $S_R$, $S_G$, and $S_B$ of the pulse-width modulation output signals are typically equal to each other ($S_R=S_G=S_B$), but the values may be different from each other.

The terms listed below may be abbreviated as follows.

Red light emitting sub-pixel: sub-pixel [R]

Green light emitting sub-pixel: sub-pixel [G]

Blue light emitting sub-pixel: sub-pixel [B]

Red light emission control signal: control signal [R]

Green light emission control signal: control signal [G]

Blue light emission control signal: control signal [B]

Red light emitting sub-pixel driving signal: driving signal [R]

Green light emitting sub-pixel driving signal: driving signal [G]

Blue light emitting sub-pixel driving signal: driving signal [B]

Red light emitting sub-pixel, green light emitting sub-pixel, and blue light emitting sub-pixel: collectively referred to as sub-pixels [R, G, B]

Red light emission control signal, green light emission control signal, and blue light emission control signal: collectively referred to as control signals [R, G, B]

Red light emitting sub-pixel driving signal, green light emitting sub-pixel driving signal, and blue light emitting sub-pixel driving signal: collectively referred to as driving signals [R, G, B]

Maximum value $x_{U-max(R,G,B)}$ among a value $x_R$ of a red light emitting sub-pixel driving signal, a value $x_G$ of a green light emitting sub-pixel driving signal, and a value $x_B$ of a blue light emitting sub-pixel driving signal input to the color LCD device driving circuit in order to drive the red light emitting sub-pixel, the green light emitting sub-pixel, and the blue light emitting sub-pixel in every pixel constituting each display area unit corresponding to each planar light source unit: driving signal maximum value in display area unit $x_{U-max}$(R, G,B )

Red light emission control signal, green light emission control signal, and blue light emission control signal corresponding to red light emitting sub-pixel driving signal, green light emitting sub-pixel driving signal, and blue light emitting sub-pixel driving signal having values equal to the driving signal maximum value in display area unit $x_{U-max}$(R,G,B) : collectively referred to as maximum control signals in display area unit [R, G, B]

Furthermore, a maximum value of values $x_R$ , $x_G$, and $x_B$ of a red light emitting sub-pixel driving signal, a green light emitting sub-pixel driving signal, and a blue light emitting sub-pixel driving signal input to the color LCD device driving circuit in order to drive the red light emitting sub-pixel, green light emitting sub-pixel, and blue light emitting sub-pixel constituting each pixel is $X_{max}$.

The light transmittance (also called aperture ratio) Lt in a liquid crystal cell constituting a sub-pixel, the luminance (display luminance) y in the sub-pixel, and the luminance (light source unit luminance) in the planar light source unit are defined as follows.

$Y_{max}$: maximum value of light source unit luminance $Lt_1$: light transmittance (aperture ratio) in a liquid crystal cell constituting a sub-pixel when assuming that a control signal corresponding to a driving signal having a value equal to the driving signal maximum value in display area unit $x_{U\text{-}max(R,G,B)}$ is supplied to the sub-pixel ($0\% \leqq Lt_1 \leqq 100\%$)

$y_1$: display luminance obtained when assuming that light transmittance (aperture ratio) in a liquid crystal cell constituting a sub-pixel is $Lt_1$ and that the light source unit luminance has the maximum value $Y_{max}$ The light source unit luminance is increased or decreased so that the display luminance when the maximum control signals in display area unit [R, G, B] are supplied to the sub-pixels [R, G, B] can be obtained. Specifically, the light source unit luminance $Y_1$ may be controlled (decreased) so that the display luminance $y_1$ can be obtained when assuming that the light transmittance (aperture ratio) in the liquid cell constituting the sub-pixel is $Lt_2$ ($Lt_2 > Lt_1$ and, for example, a maximum aperture ratio 100%). For example, the light source unit luminance $Y_1$ may be controlled so that $Y_1 \cdot Lt_2 = y_1 \cdot Lt_1$ is satisfied. The light source unit luminance $Y_1$ is controlled on the basis of ON times $t_{R\text{-}ON}$, $t_{G\text{-}ON}$, and $t_{B\text{-}ON}$ of the LEDs.

In the above-described method for driving the planar light source device, method for driving the color LCD device assembly, and method for driving. the LED including various preferable configurations, the red LED emits red light having a wavelength of 640 nm, the green LED emits green light having a wavelength of 530 nm, and the blue LED emits blue light having a wavelength of 450 nm.

In the planar light source device, a plurality of red LEDs emitting red light (e.g., the wavelength is 640 nm), a plurality of green LEDs emitting green light (e.g., the wavelength is 530 nm), and a plurality of blue LEDs emitting blue light (e.g., the wavelength is 450 nm) are placed and arranged in a housing. LEDs emitting light of a fourth color other than red, green, and blue may be further provided. By partitioning the plurality of LEDs by using partitions, planar light source units constituting the planar light source device can be obtained. Assuming that each planar light source unit includes an LED unit having a combination of (a red LED, a green LED, and a blue LED), (a red LED, two green LEDs, and a blue LED), (two red LEDs, two green LEDs, and a blue LED) or the like, those colors being mixed to emit white light, each planar light source unit includes at least one LED unit. When an LED unit includes a plurality of LEDs of the same color, the plurality of LEDs of the same color may be regarded as an LED, so as to apply the present invention.

The LED may have a so-called face-up configuration or a flip-chip configuration. That is, the LED includes a substrate and a light emitting layer provided on the substrate. Light may be directly emitted from the light emitting layer, or may be emitted from the light emitting layer through the substrate. More specifically, the LED has a laminated configuration including a first clad layer including a first-conductive-type (e.g., n-type) compound semiconductor layer provided on the substrate, an active layer provided on the first clad layer, and a second clad layer including a second-conductive-type (e.g., p-type) compound semiconductor layer provided on the active layer. Also, the LED includes a first electrode electrically connected to the first clad layer and a second electrode electrically connected to the second clad layer. The layers constituting the LED may de made of a known compound semiconductor material depending on a wavelength of light to be emitted.

Luminance of each planar light source unit (light source unit luminance) is desirably not affected by an adjoining planar light source unit as much as possible. Specifically, as in a Lambertian method, a lens causing a strong light intensity to a straight direction may be provided at a light emitting portion of the LED, or a partition opaque to illuminating light from planar light source units may be provided between the planar light source units. Also, the configuration may be designed so that the luminance in a planar light source unit (light source unit luminance) is affected by another planar light source unit.

When a configuration is designed so that light emitted from the LED directly enters the color LCD device positioned above, that is, when light is emitted from the LED mostly in a z-axis direction, luminance variation may occur in the planar light source device. In order to prevent the occurrence of such a phenomenon, the following two-dimensional direction emitting configuration may be used. In this configuration, an LED assembly in which a light extracting lens is attached to an LED is used as a light source, light emitted from the LED is totally reflected at the top of the light extracting lens, and the light is emitted mainly in the horizontal direction of the light extracting lens. This configuration is disclosed in p. 128, vol. 889 of Nikkei Electronics published on Dec. 20, 2004, for example.

The planar light source device may further include a group of sheets having an optical function, such as a diffuser plate, a diffuser sheet, a prism sheet, and a polarizing converting sheet, and a reflective sheet.

The transmissive color LCD device includes, for example, a front panel provided with a first transparent electrode; a rear panel provided with a second transparent electrode; and liquid crystal material placed between the front and rear panels.

More specifically, the front panel includes a first substrate made of a glass substrate or a silicon substrate; the first transparent electrode (also called a common electrode and made of ITO (indium tin oxide) or the like) provided on an inner surface of the first substrate; and a polarizing film provided on an outer surface of the first substrate. Furthermore, in the front panel, color filters covered with an overcoat layer made of acrylic resin or epoxy resin are provided on the inner surface of the first substrate. The first transparent electrode is provided on the overcoat layer. An oriented film is provided on the first transparent electrode. The color filters may be placed in the following arrangement patterns: a delta arrangement, a stripe arrangement, a diagonal arrangement, and a rectangle arrangement. On the other hand, the rear panel includes a second substrate made of a glass substrate or a silicon substrate; switching elements provided on an inner surface of the second substrate; the second transparent electrode (also called a pixel electrode and made of ITO or the like) in which conduction/non-conduction is controlled by the switching elements; and the polarizing film provided on an outer surface of the second substrate. An oriented film is provided over an entire surface including the surface of the second transparent electrode. Known members and materials may be used as the various members and materials of the transmissive color LCD device. Examples of the switching elements include a three-terminal element, such as a MOS (metal oxide semiconductor) FET (field-effect transistor) or a TFT (thin-film transistor) provided on a single-crystal silicon semiconductor substrate, and a two-terminal element, such as an MIM (metal injection molding) element, a varistor element, or a diode.

An area where the first and second transparent electrodes overlap each other and which includes a liquid crystal cell corresponds to one sub-pixel. Each pixel includes a red light emitting sub-pixel (sub-pixel [R]), which includes a combination of the area and a color filter to pass red light, a green light emitting sub-pixel (sub-pixel [G]), which includes a combination of the area and a color filter to pass green light, and a blue light emitting sub-pixel (sub-pixel [B]), which includes a combination of the area and a color filter to pass blue light. The arrangement pattern of the sub-pixels [R], [G], and [B] is the same as that of the above-described color filters.

When the number $M_0 \times N_0$ of pixels arranged in a two-dimensional matrix pattern is represented by ($M_0$, $N_0$), some examples of image display resolution can be used as the value of ($M_0$, $N_0$): (1920, 1035) , (720, 480) , and (1280, 960), in addition to VGA (640, 480), S-VGA (800, 600), XGA (1024, 768), APRC (1152, 900), S-XGA (1280, 1024), U-XGA (1600, 1200), HD-TV (1920, 1080), and Q-XGA (2048, 1536). However, the value of ($M_0$, $N_0$) is not limited to those values. Examples of a relationship between ($M_0$, $N_0$) and (P, Q) are shown in the following table 1, although not limited. The number of pixels constituting a display area unit may be 20×20 to 320×240, preferably, 50×50 to 200×200. The number of pixels in the display area unit may be constant or different.

TABLE 1

| | Value of P | Value of Q |
|---|---|---|
| VGA (640, 480) | 2~32 | 2~24 |
| S-VGA (800, 600) | 3~40 | 2~30 |
| XGA (1024, 768) | 4~50 | 3~39 |
| APRC (1152, 900) | 4~58 | 3~45 |
| S-XGA (1280, 1024) | 4~64 | 4~51 |
| U-XGA (1600, 1200) | 6~80 | 4~60 |
| HD-TV (1920, 1080) | 6~86 | 4~54 |
| Q-XGA (2048, 1536) | 7~102 | 5~77 |
| (1920, 1035) | 7~64 | 4~52 |
| (720, 480) | 3~34 | 2~24 |
| (1280, 960) | 4~64 | 3~48 |

The driving circuit to drive the planar light source unit may include an operating circuit to determine pulse-width modulation unit clocks $CL_{R\text{-}Unit}$, $CL_{G\text{-}unit}$, $CL_{B\text{-}Unit}$, and $CL_{unit}$, the number of frequency division cycles, ON times $t_{R\text{-}ON}$, $t_{G\text{-}ON}$, $t_{B\text{-}ON}$, and $t_{ON}$, and OFF times $t_{R\text{-}OFF}$, $t_{G\text{-}OFF}$, $t_{B\text{-}OFF}$, and $t_{OFF}$, and to obtain values $S_R$, $S_G$, $S_B$, and S of pulse-width modulation output signals; a storage device (memory); an oscillator to generate unit clocks in a system clock; and a frequency divider to determine the number of frequency division cycles of the system clock. Furthermore, the driving circuit may include, for example, an LED driving circuit, a photodiode control circuit, switching elements to control flow of current to LEDs, and an LED driving power supply. The color LCD device driving circuit to drive the color LCD device includes a known circuit, such as a timing controller. The luminance of the display area units (display luminance) and the luminance of the planar light source units (light source unit luminance) are controlled for every frame. The number of pieces of image information transmitted as an electric signal to the color LCD device driving circuit in one second (the number of images per second) is a frame frequency (frame rate), and an inverse number of the frame frequency is frame time (unit: second).

In the method for driving the planar light source device, the method for driving the color LCD device assembly, the method for driving the LED, and the pulse-width modulating method according to an embodiment of the present invention, the respective pulse-width modulation unit clocks $CL_{R\text{-}unit}$, $CL_{G\text{-}unit}$, $CL_{B\text{-}unit}$, and $CL_{unit}$ are adjusted to long or short by increasing or decreasing the number of frequency division cycles of the system clock and the length of the ON times $t_{R\text{-}ON}$, $t_{G\text{-}ON}$, $t_{B\text{-}ON}$, and $t_{ON}$ is controlled to adjust variation and difference, if the variation and difference occur in characteristics (e.g., Vf characteristic and light output characteristic) of the LEDs due to heat generated by drive of the LEDs. Accordingly, the length of the ON times $t_{R\text{-}ON}$, $t_{G\text{-}ON}$, $t_{B\text{-}ON}$, and $t_{ON}$ can be easily and accurately controlled. Accordingly, for example, white balance of white light (temperature of white color) emitted from the planar light source units can be kept constant with high accuracy. Furthermore, in driving of each LED, the relationship among expressions (1-1), (1-2), and (1-3) is the same regardless of the values $S_R$, $S_G$, and $S_B$ of the pulse-width modulation output signals. Thus, the same algorithm can be used in backlight adjustment, for example, a maximum value of $S_R$, $S_G$, and $S_B$ is set to 255 in daylight, whereas a maximum value of $S_R$, $S_G$, and $S_B$ is set to 127 in the darkness.

DESCRIPTION OF THE PREFERRED EMBODIMENTS

Hereinafter, an embodiment of the present invention is described with reference to the drawings.

First Embodiment

A first embodiment of the present invention relates a method for driving a planar light source device, a method for driving a color liquid crystal display (LCD) device assembly, a method for driving a light emitting diode (LED), and a pulse-width modulating method.

Figure 3:
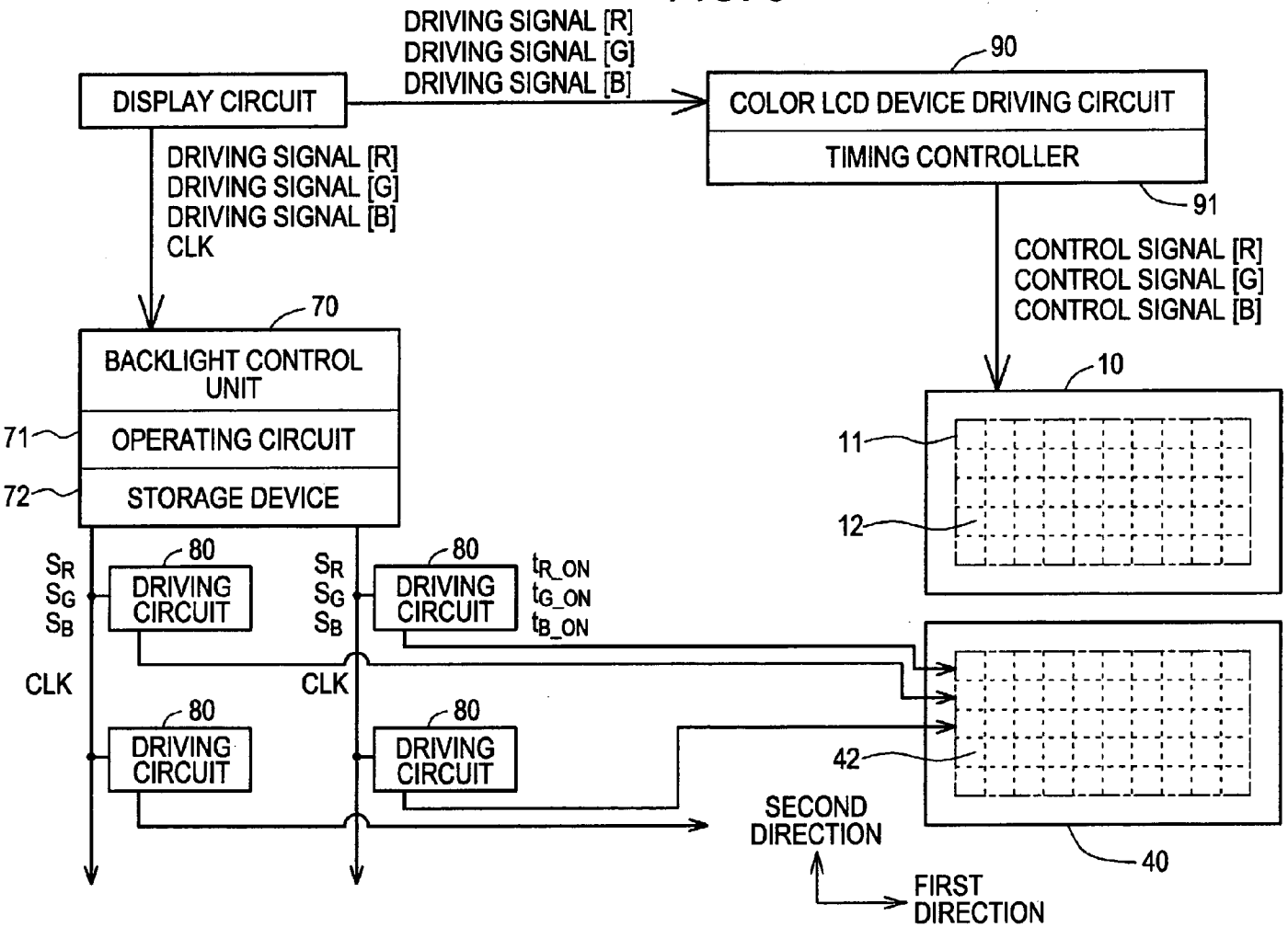
FIG. 3 is a conceptual view showing a color LCD device assembly including a color LCD device, a planar light source device, driving circuits, and a color LCD device driving circuit appropriate for use in a first embodiment.

As shown in a conceptual diagram in FIG. 3, a color LCD device 10 according to the first embodiment includes a display area 11 where $M_0 \times N_0$ pixels are arranged in a two-dimensional matrix pattern (Mo pixels along a first direction and $N_0$ pixels along a second direction). The display area 11 includes P×Q display area units 12, each including a plurality of pixels. More specifically, an HD-TV standard is satisfied as resolution for image display, and the number of pixels $M_0 \times N_0$ ($M_0$, $N_0$) arranged in a two-dimensional matrix pattern is (1920, 1080), for example. The display area 11 (indicated by a dashed-dotted line in FIG. 3) including the pixels arranged in a two-dimensional matrix pattern includes the P×Q display area units 12 (borders are indicated by dotted lines). Herein, the value of (P, Q) is (19, 12), for example. However, the number of the display area units 12 (and planar light source units 42 described below) shown in FIG. 3 is different from this value for simplification of the figure. Each display area unit 12 includes a plurality of (M×N) pixels. The number of pixels constituting each display area unit 12 is about ten thousand, for example. Each pixel includes three sub-pixels [R, G, B].

Figure 5:
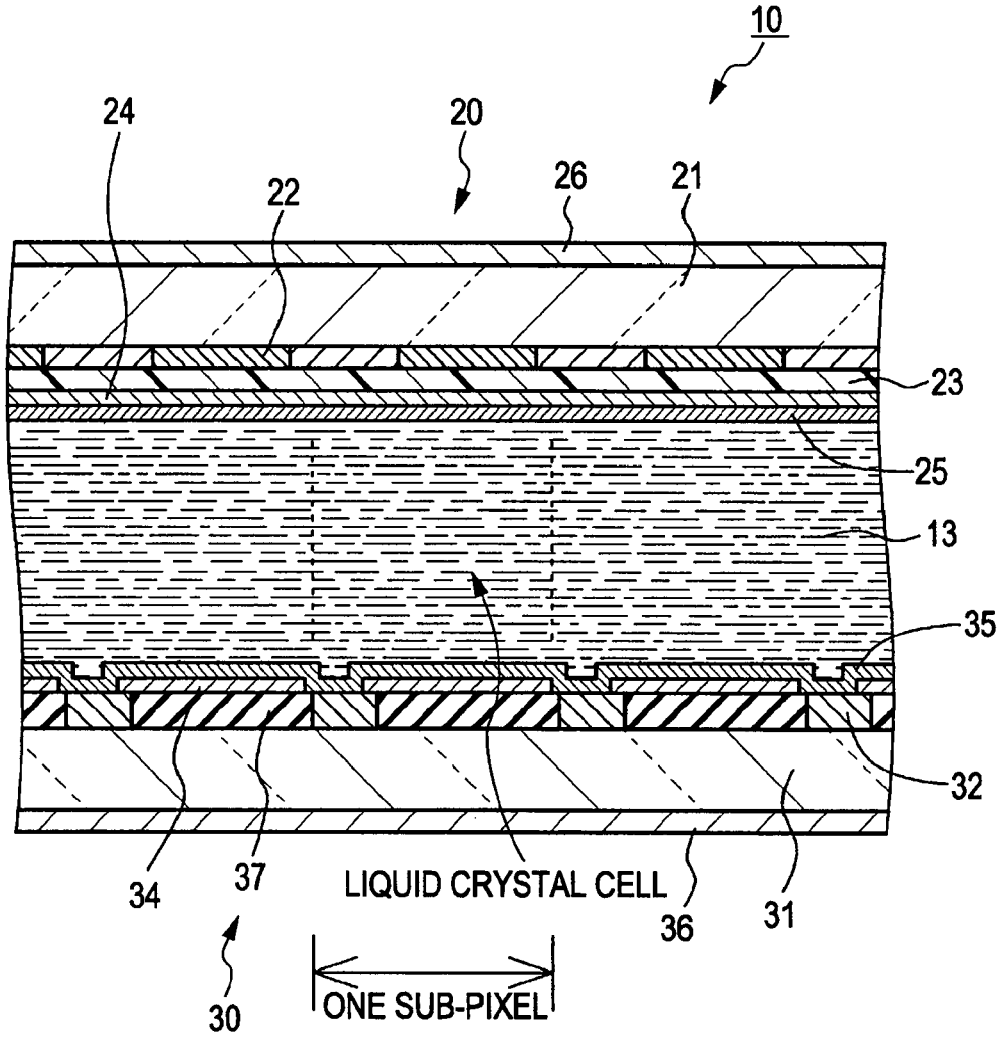
FIG. 5 is a schematic partial cross-sectional view showing the color LCD device assembly.

As shown in a schematic partial cross-sectional view in FIG. 5, the color LCD device 10 includes a front panel 20 provided with a first transparent electrode 24; a rear panel 30 provided with a second transparent electrode 34; and a liquid crystal material 13 provided between the front panel 20 and the rear panel 30.

The front panel 20 includes, for example, a first substrate 21 made of a glass substrate and a polarizing film 26 provided on an outer surface of the first substrate 21. Color filters 22 covered with an overcoat layer 23 made of acrylic resin or epoxy resin are provided on an inner surface of the first substrate 21. The first transparent electrode (also called a common electrode and made of ITO (indium tin oxide)) 24 is provided on the overcoat layer 23, and an oriented film 25 is provided on the first transparent electrode 24. On the other hand, the rear panel 30 includes, for example, a second substrate 31 made of a glass substrate, switching elements (specifically, thin-film transistors (TFTs)) 32 provided on an inner surface of the second substrate 31, the second transparent electrode (also called a pixel electrode and made of ITO) 34 of which conduction/non-conduction is controlled by the switching elements 32, and a polarizing film 36 provided on an outer surface of the second substrate 31. An oriented film 35 is provided over an entire surface including a surface of the second transparent electrode 34. The front panel 20 and the rear panel 30 are bonded to each other in their periphery via a seal (not shown). The switching elements 32 are not limited to the TFTs, but metal injection molding (MIM) elements can also be used. Also, an insulating layer 37 is provided between the switching elements 32.

Known members and known liquid crystal material can be used for this transmissive color LCD device. Thus, the detailed description thereof is omitted.

Figure 6A:
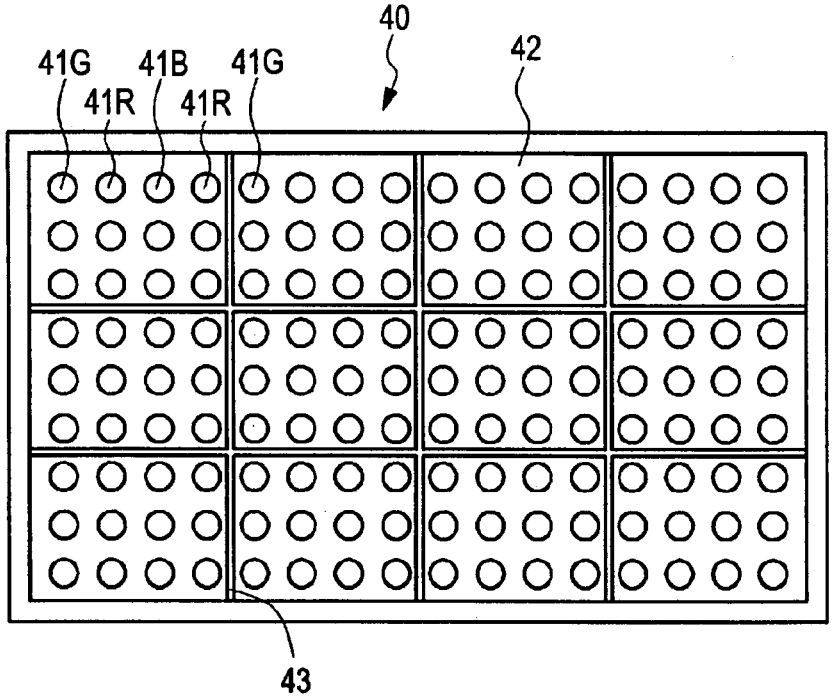
FIG. 6A schematically shows an arrangement state of LEDs in the planar light source device.
Figure 6B:
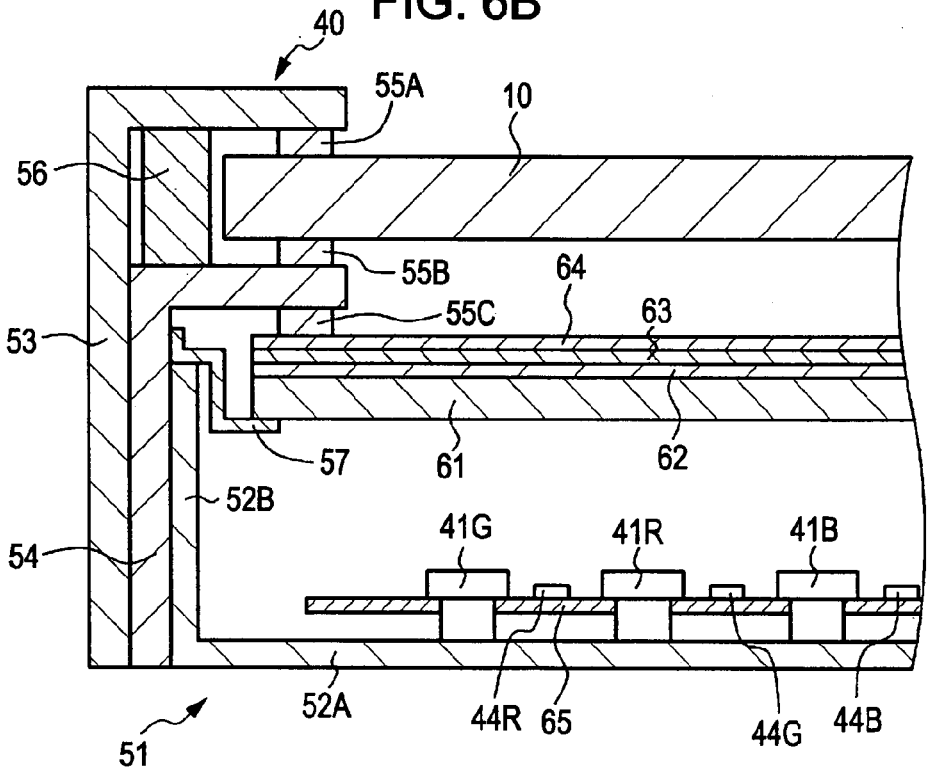
FIG. 6B is a schematic partial cross-sectional view of the planar light source device and the color LCD device assembly.

A planar light source device (backlight) 40 includes P×Q planar light source units 42 corresponding to the P×Q display area units 12. Each of the planar light source units 42 lights the corresponding display area unit 12 from the back. Although the planar light source device 40 is actually placed under the color LCD device 10, the both devices 10 and 40 are separately shown in FIG. 3. Position and arrangement of LEDs in the planar light source device 40 are schematically shown in FIG. 6A. A schematic partial cross-sectional view of the planar light source device 40 and the color LCD device assembly is shown in FIG. 6B.

The planar light source device 40 includes a housing 51 including an external frame 53 and an inner frame 54. An end portion of the transmissive color LCD device 10 is held by the external frame 53 and the inner frame 54 via spacers 55A and 55B so as to be sandwiched therebetween. A guide member 56 is placed between the external frame 53 and the inner frame 54, so that the color LCD device 10 sandwiched by the external frame 53 and the inner frame 54 is fixed. A diffuser plate 61 is provided at an upper side of the housing 51, inside the housing 51. The diffuser plate 61 is attached to the inner frame 54 via a spacer 55C and a bracket 57. Also, a group of optical-function sheets including a diffuser sheet 62, a prism sheet 63, and a polarizing converting sheet 64 is laminated on the diffuser plate 61.

A reflective sheet 65 is provided at a lower side of the housing 51, inside the housing 51. The reflective sheet 65 is placed such that a reflective surface thereof faces the diffuser plate 61, and is attached to a bottom 52A of the housing 51 via an attaching member (not shown). For example, the reflective sheet 65 can be made of a silver reflection enhancing film formed by laminating a silver reflective film, a low-refractive-index film, and a high-refractive-index film in this order on a sheet substrate. The reflective sheet 65 reflects light emitted from LEDs 41 or light reflected from a side surface 52B of the housing 51 or a partition 43 shown in FIG. 6A. Accordingly, red light emitted from a plurality of red LEDs 41R, green light emitted from a plurality of green LEDs 41G, and blue light emitted from a plurality of blue LEDs 41B are mixed, so that white light of high chromatic purity can be obtained as illuminating light. The illuminating light passes through the group of optical function sheets including the diffuser plate 61, the diffuser sheet 62, the prism sheet 63, and the polarizing converting sheet 64, and lights the color LCD device 10 from the back. Photodiodes 44R, 44G, and 44B are placed near the bottom 52A of the housing 51. The photodiode 44R has a red filter to measure the intensity of red light, the photodiode 44G has a green filter to measure the intensity of green light, and the photodiode 44B has a blue filter to measure the intensity of blue light.

The LEDs 41R, 41G, and 41B are arranged in the following manner. For example, a plurality of LED units, each unit including a set of a red LED 41R to emit red light (the wavelength is 640 nm, for example); a green LED. 41G to emit green light (the wavelength is 530 nm, for example); and a blue LED 41B to emit blue light (the wavelength is 450 nm, for example), can be arranged in the horizontal and vertical directions.

The planar light source units 42 constituting the planar light source device 40 can be obtained by partitioning the plurality of LEDs 41 by partitions 43 that are opaque to illuminating light from the planar light source units 42 (more specifically, light from the LEDs 41). In this configuration, luminance in each planar light source unit 42 is not affected by adjoining planar light source units 42.

A driving circuit to perform ON/OFF control of the red LEDs 41R, green LEDs 41G, and blue LEDs 41B constituting each planar light source unit 42 on the basis of the pulse-width modulation includes a backlight control unit 70 and planar light source unit driving circuits 80. Herein, the backlight control unit 70 includes an operating circuit 71 and a storage device (memory) 72. On the other hand, each planar light source unit driving circuit 80 includes an operating circuit 81, a storage device (memory) 82, an oscillator 83 serving as a system clock, a frequency divider 84, an LED driving circuit 85, a photodiode control circuit 86, switching elements 87R, 87G, and 87B including FETs, and an LED driving power supply (constant current source) 88. Known circuits may be used as those circuits constituting the backlight control unit 70 and the planar light source unit driving circuit 80. On the other hand, a color LCD device driving circuit 90 to drive the color LCD device 10 includes a known circuit, such as a timing controller 91. Also, the color LCD device 10 is provided with a gate driver and a source driver (not shown) to drive the switching elements 32 including TFTs.

Each pixel includes a set of three sub-pixels: a sub-pixel [R] (red light emitting sub-pixel), a sub-pixel [G] (green light emitting sub-pixel), and a sub-pixel [B] (blue light emitting sub-pixel). In the following description, luminance of the respective sub-pixels [R, G, B] is controlled at 8 bits in $2^8$ levels from 0 to 255 (gradation control). Accordingly, each of values $x_R$, $x_G$, and $x_B$ of driving signals [R, G, B] input to the color LCD device driving circuit 90 in order to drive the sub-pixels [R, G, B] of each pixel constituting each display area unit 12 has values of $2^8$ levels. Also, each of values $S_R$, $S_G$, and $S_B$ of pulse-width modulation output signals to control light emission time of the red, green, and blue LEDs constituting each planar light source unit has values of $2^8$ levels from 0 to 255. However, the present invention is not limited to this, but 10-bit control can be performed in $2^{10}$ levels from 0 to 1023. In that case, an expression of an 8-bit value may be quadrupled, for example.

In the following description, assume that $S_R=S_G=S_B=S$.

In the color LCD device driving circuit 90, control signals [R, G, B] are generated on the basis of input driving signals [R, G, B], and the control signals [R, G, B] are supplied (output) to the sub-pixels [R, G, B]. The control signals [R, G, B] have values of 2.2-th power of values of the driving signals [R, G, B]. That is, the control signals [R, G, B] are transmitted from the timing controller 91 of the color LCD device driving circuit 90 to the gate driver and the source driver of the color LCD device 10 in a known method, the switching elements 32 constituting the respective sub-pixels are driven on the basis of the control signals [R, G, B], and a predetermined voltage is applied to the first transparent electrode 24 and the second transparent electrode 34. Accordingly, the light transmittance (aperture ratio) Lt in the liquid crystal cell constituting the respective sub-pixels is controlled. As the values of the control signals [R, G, B] are larger, the light transmittance (aperture ratio) Lt and the luminance of the sub-pixels [R, G, B] are higher. That is, an image (normally a point) formed by light passed through the sub-pixels [R, G, B] is bright.

The display area 11 including the pixels arranged in a two-dimensional matrix pattern includes P×Q display area units 12. If this state is expressed by using "rows" and "columns", the display area 11 includes display area units 12 of Q rows×P columns. Each of the display area units 12 includes a plurality of (M×N) pixels. If this state is expressed by using "rows" and "columns", the display area unit 12 includes pixels of N rows x M columns. Among the display area units' 12 and the planar light source units 42 arranged in a two-dimensional matrix pattern, the display area unit and the planar light source unit positioned at a q-th row and a p-th column (q=1, 2, . . . , Q and p=1, 2, . . . , P) are referred to as a display area unit $\mathbf{12}_{(q,p)}$ and a planar light source unit $\mathbf{42}_{(q,p)}$, respectively. Among the pixels in the display area unit 12(q, p), the pixel positioned at an n-th row and an m-th column (n=1, 2, . . . , N and m=1, 2, . . . , M) is referred to as a pixel $PX_{(q,p/n,m)}$. Respective sub-pixels are referred to as follows. Furthermore, various control signals or their values corresponding to image signals supplied from the color LCD device driving circuit 90 to the respective sub-pixels [R, G, B] in order to control the light transmittance (aperture ratio) Lt in the pixel $PX_{(q,p/n,m)}$ may be referred to as follows. As a method for transmitting driving signals, an LVDS (low voltage differential signaling) method can be used. In the LVDS method, a parallel signal is transmitted after being converted to a low voltage differential serial signal. In this method, noise and unnecessary radiation can be reduced and the number of transmission lines can be reduced. However, the signal transmitting method is not limited to the LVDS method, but an LVTTL (low voltage transistor transistor logic) method may also be adopted.

Sub-pixel [R]: sub-pixel $[R]_{(q,p/n,m)}$
Sub-pixel [G]: sub-pixel $[G]_{(q,p/n,m)}$
Sub-pixel [B]: sub-pixel $[B]_{(q,p/n,m)}$
Driving signal [R]: driving signal $[R]_{(q,p/n,m)}$
Driving signal [G]: driving signal $[G]_{(q,p/n,m)}$
Driving signal [B]: driving signal $[B]_{(q,p/n,m)}$
Value $x_R$ of driving signal $[R]_{(q,p/n,m)}$: $x_{R-(q,p/n,m)}$
Value $x_G$ of driving signal $[G]_{(q,p/n,m)}$: $x_{G-(q,p/n,m)}$
Value $x_B$ of driving signal $[B]_{(q,p/n,m)}$: $x_{B-(q,p/n,m)}$
Sub-pixels [R, G, B]: sub-pixel $[R, G, B]_{(q,p/n,m)}$
Driving signals [R, G, B]: driving signal $[R, G, B]_{(q,p/n,m)}$
Values $x_R$, $x_G$, and $x_B$ of driving signals $[R, G, B]_{(q,p/n,m)}$: $x_{R-(q,p/n,m)}$, $x_{G-(q,p/n,m)}$, and $x_{B-(q,p/n,m)}$
Control signal [R]: control signal $[R]_{(q,p/n,m)}$
Control signal [G]: control signal $[G]_{(q,p/n,m)}$
Control signal [B]: control signal $[B]_{(q,p/n,m)}$
Value $X_R$ of control signal $[R]_{(q,p/n,m)}$: $X_{R-(q,p/n,m)}$
Value $X_G$ of control signal $[G]_{(q,p/n,m)}$: $X_{G-(q,p/n,m)}$
Value $X_B$ of control signal $[B]_{(q,p/n,m)}$: $X_{B-(q,p/n,m)}$ In each of the planar light source units 42, a maximum value among the values $x_{R-(q,p/n,m)}$, $x_{G-(q,p/n,m)}$, and $x_{B-(q,p/n,m)}$ of the driving signals $[R, G, B]_{(q,p/n,m)}$ input to the color LCD device driving circuit 90 in order to drive sub-pixels $[R, G, B]_{(q,p/n,m)}$ in all pixels constituting each display area unit $\mathbf{12}_{(q,p)}$ is referred to as "a driving signal maximum value in display area unit $x_{U-max(R,G,B)-(q,p)}$".

Display luminance and light source unit luminance are controlled for every frame. In each frame, an operation of the LCD device is synchronized with an operation of the planar light source device.

For example, the amount of light input to an image pickup tube is represented by y', a value of an output signal from the image pickup tube, that is, a value of a driving signal output from a broadcast station or the like and is input to the color LCD device driving circuit 90 in order to control light transmittance of pixels is represented by x, and luminance (display luminance) of a pixel driven by a control signal corresponding to the driving signal is represented by y. In this case, the value x of the driving signal can be expressed by a function of 0.45-th power of the amount of input light y'. The value X of the control signal or the display luminance y can be expressed by a function of 2.2-th power of the value x of the driving signal. A relationship between the display luminance y and the function of 2.2-th power of the value x of the driving signal is called a γ characteristic. Herein, $y=x^{2.2}=(y'^{0.45})^{2.2}=y'$ is satisfied. In this way, a system from a broadcast station to a television receiver or a system from a video playback apparatus to the television receiver is established so that images picked up by the image pickup tube are accurately reproduced on a screen.

Hereinafter, a method for driving the planar light source device, a method for driving the color LCD device assembly, a method for driving the LED, and a pulse-width modulating method according to the first embodiment are described.

[Step-100]

Driving signals [R, G, B] and a clock signal CLK of a frame output from a known display circuit, such as a scan converter, are input to the backlight control unit 70 and the color LCD device driving circuit 90 (see FIG. 3). The driving signals [R, G, B] are output signals from an image pickup tube. For example, the driving signals are output from a broadcast station, and are input to the color LCD device driving circuit 90 in order to control light transmittance of pixels. When the amount of light input to the image pickup tube is represented by y', values of the driving signals can be represented by a function of 0.45-th power of the amount of input light y'. The values $x_R$ , $x_G$, and $x_B$ of the driving signals [R, G, B] of the frame input to the backlight control unit 70 are temporarily stored in the storage device (memory) 72 included in the backlight control unit 70. Also, the values $x_R$, $x_G$, and $x_B$ of the driving signals [R, G, B] of the frame input to the color LCD device driving circuit 90 are temporarily stored in a storage device (not shown) included in the color LCD device driving circuit 90.

[Step-110]

Then, the operating circuit 71 included in the backlight control unit 70 reads the values of the driving signals [R, G, B] stored in the storage device 72. Then, the operating circuit 71 calculates a maximum value (driving signal maximum value in display area unit $x_{U\text{-}max(R,G,B)\text{-}(q,p)}$) among the values $x_{R\text{-}(q,p/n,m)}$, $x_{G\text{-}(q,p/n,m)}$, and $x_{B\text{-}(q,p/n,m)}$ (these values are already stored in the storage device 72 included in the backlight control unit 70) of the driving signals $[R, G, B]_{(q,p/n,m)}$ that are input also to the color LCD device driving circuit 90 in order to drive sub-pixels $[R, G, B]_{(q,p/n,m)}$ in all of the pixels $PX_{(q,p/n,m)}$ constituting the (p,q)-th (first, p=1 and q=1) display area unit $\mathbf{12}_{(q,p)}$. Then, the driving signal maximum value in display area unit $_{U\text{-}max(R,G,B)\text{-}(q,p)}$ is stored in the storage device 72. This step is performed for all of m=1, 2, . . . , M and n=1, 2, . . . , N, that is, all of the M×N pixels.

For example, when $x_{R\text{-}(n,m/q,p)}$ is a value corresponding to "110", when $x_{G\text{-}(n,m/q,p)}$ is a value corresponding to "150", and when $x_{B\text{-}(n,m/q,p)}$ is a value corresponding to "50", $x_{U\text{-}max(R,G,B)\text{-}(q,p)}$ is a value corresponding to "150".

This operation is repeated from (p, q)=(1, 1) to (P, Q), and driving signal maximum values $x_{U\text{-}max(R,G,B)\text{-}(q,p)}$ in all of the display area units 12(q,p) are stored in the storage device 72.

Then, the luminance of the planar light source unit $\mathbf{42}_{(q,p)}$ (light source unit luminance) corresponding to the display area unit $\mathbf{12}_{(q,p)}$ is increased or decreased under control by the planar light source unit driving circuit 80 (described below) so that the display luminance to be obtained when control signals $[R, G, B]_{(q,p)}$ corresponding to driving signals $[R, G, B]_{(q,p)}$ having values equal to the driving signal maximum value in display area unit $x_{U\text{-}max(R,G,B)\text{-}(q,p)}$ are supplied to the sub-pixels $[R, G, B]_{(q,p)}$ can be obtained in the planar light source unit $\mathbf{42}_{(q,p)}$. That is, the display luminance to be obtained when control signals corresponding to driving signals having values equal to the driving signal maximum value in display area unit $x_{U\text{-}max(R,G,B)\text{-}(q,p)}$ are supplied to the sub-pixels $[R, G, B]_{(q,p)}$ is represented by $y_1$. The light transmittance (aperture ratio) in liquid crystal cells constituting the respective sub-pixels is represented by $Lt_1$ ($0\% \leqq Lt_1 \leqq 100\%$). The light source unit luminance $Y_1$ of the planar light source unit $\mathbf{42}_{(q,p)}$ may be controlled so that the display luminance $y_1$ can be obtained when the light transmittance (aperture ratio) in the liquid crystal cells constituting the respective sub-pixels is $Lt_2$ (note that $Lt_2 > Lt_1$, for example, 100%). That is, the light source unit luminance $Y_1$ may be controlled on the basis of the following expression (2) expressing a planar light source unit luminance controlling function $g(x_{nol\text{-}max})$ so that $Y_1 \cdot Lt_2 = y_1 \cdot Lt_1$ is satisfied. A relationship among parameters to control the light source unit luminance $Y_1$ to obtain the display luminance $y_1$ when the light transmittance (aperture ratio) in liquid crystal cells constituting sub-pixels is $Lt_2$ may be obtained in advance, the parameters including the driving signal maximum value in display area unit, values of control signals corresponding to driving signals having values equal to the maximum value, the display luminance $y_1$ to be obtained when the control signals are supplied to the sub-pixels, and the light transmittance (aperture ratio) $Lt_1$ in liquid crystal cells constituting the sub-pixels.

Herein, control of the luminance of the planar light source unit $\mathbf{42}_{(q,p)}$ is based on the following expression (2) expressing the planar light source unit luminance controlling function $g(x_{nol\text{-}max})$. That is, when $x_{nol\text{-}max} = x_{U\text{-}max(R,G,B)}/x_{max}$, the planar light source unit luminance controlling function $g(x_{nol\text{-}max})$ can be expressed by $g(x_{nol\text{-}max}) = a_1 \cdot (x_{nol\text{-}max})^{2.2} + a_0$ (2). Note that $a_1$ and $a_0$ are constants and $a_1 + a_0 = 1$, $0 < a_0 < 1$, $0 < a_1 < 1$. For example, $a_1 = 0.99$ and $a_0 = 0.01$.

Then, the value of $g(x_{nol\text{-}max})$ obtained in the operating circuit 71 of the backlight control unit 70 is converted to a corresponding integer in a range of 0 to 255 on the basis of a table stored in the storage device 72. In this way, in the operating circuit 71 of the backlight control unit 70, a value $S_{R\text{-}(q,p)}$ of a pulse-width modulation output signal to control light emission time of the red LED $\mathbf{41}R_{(q,p)}$, a value $S_{G\text{-}(q,p)}$ of a pulse-width modulation output signal to control light emission time of the green LED $\mathbf{41}G_{(q,p)}$, and a value $S_{B\text{-}(q,p)}$ of a pulse-width modulation output signal to control light emission time of the blue LED $\mathbf{41}B_{(q,p)}$ in the planar light source unit $\mathbf{42}_{(q,p)}$ can be obtained. Note that $S_{R\text{-}(q,p)} = S_{G\text{-}(q,p)} = S_{B\text{-}(q,p)}$.

[Step-120]

Figure 4:
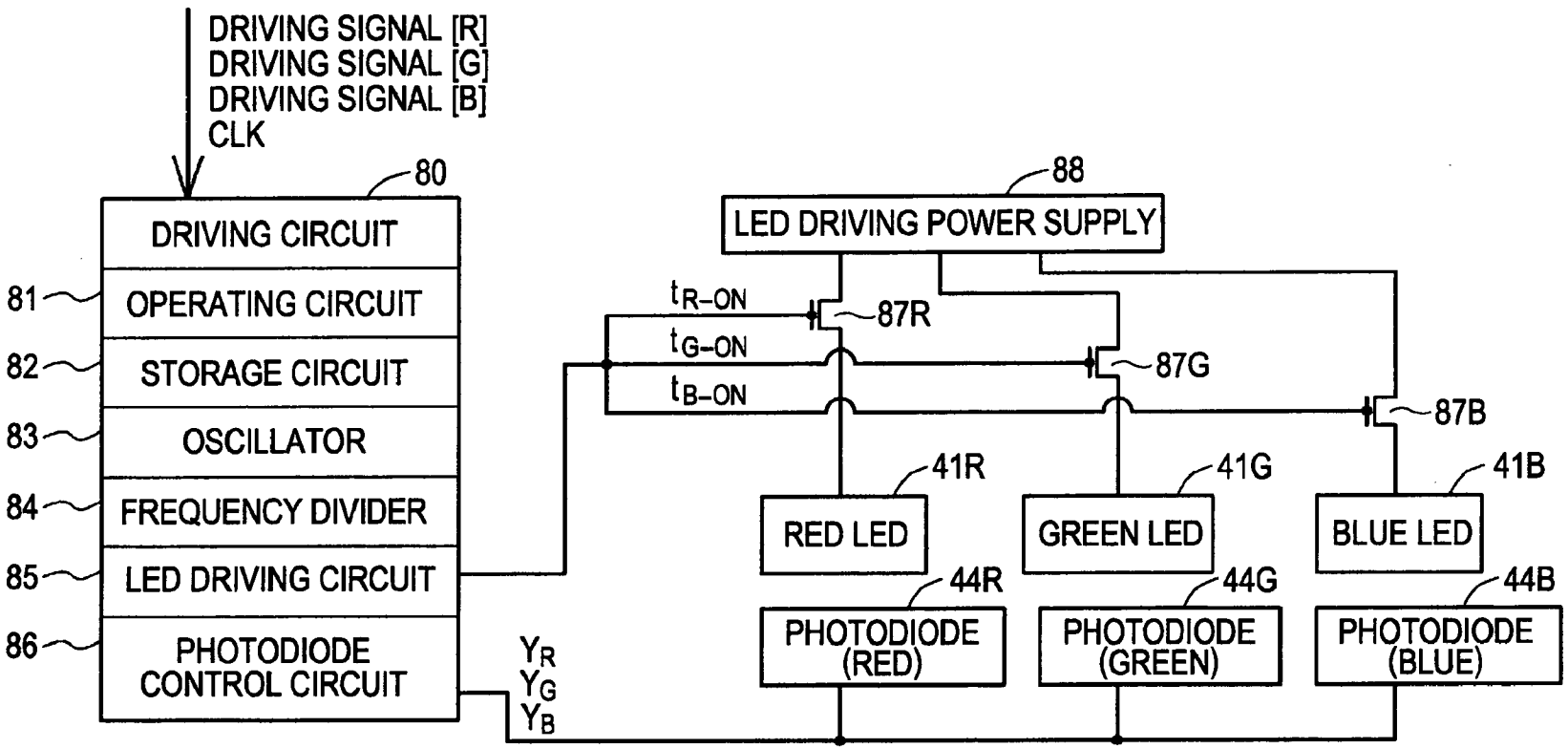
FIG. 4 is a conceptual view showing a part of the driving circuit appropriate for use in the first embodiment.

Then, the values $S_{R\text{-}(q,p)}$, $S_{G\text{-}(q,p)}$, and $S_{B\text{-}(q,p)}$ of the pulse-width modulation output signals obtained in the operating circuit 71 of the backlight control unit 70 are transmitted to the storage device 82 of the planar light source unit driving circuit $\mathbf{80}_{(q,p)}$ corresponding to the planar light source unit $\mathbf{42}_{(q,p)}$ and are stored in the storage device 82. Also, the clock signal CLK is transmitted to the planar light source unit driving circuit 80 (see FIG. 4).

[Step-130]

This step corresponds to the method for driving the planar light source device, the method for driving the color LCD device assembly, the method for driving the LEDs, and the pulse-width modulating method according to the first embodiment.

Figure 1:
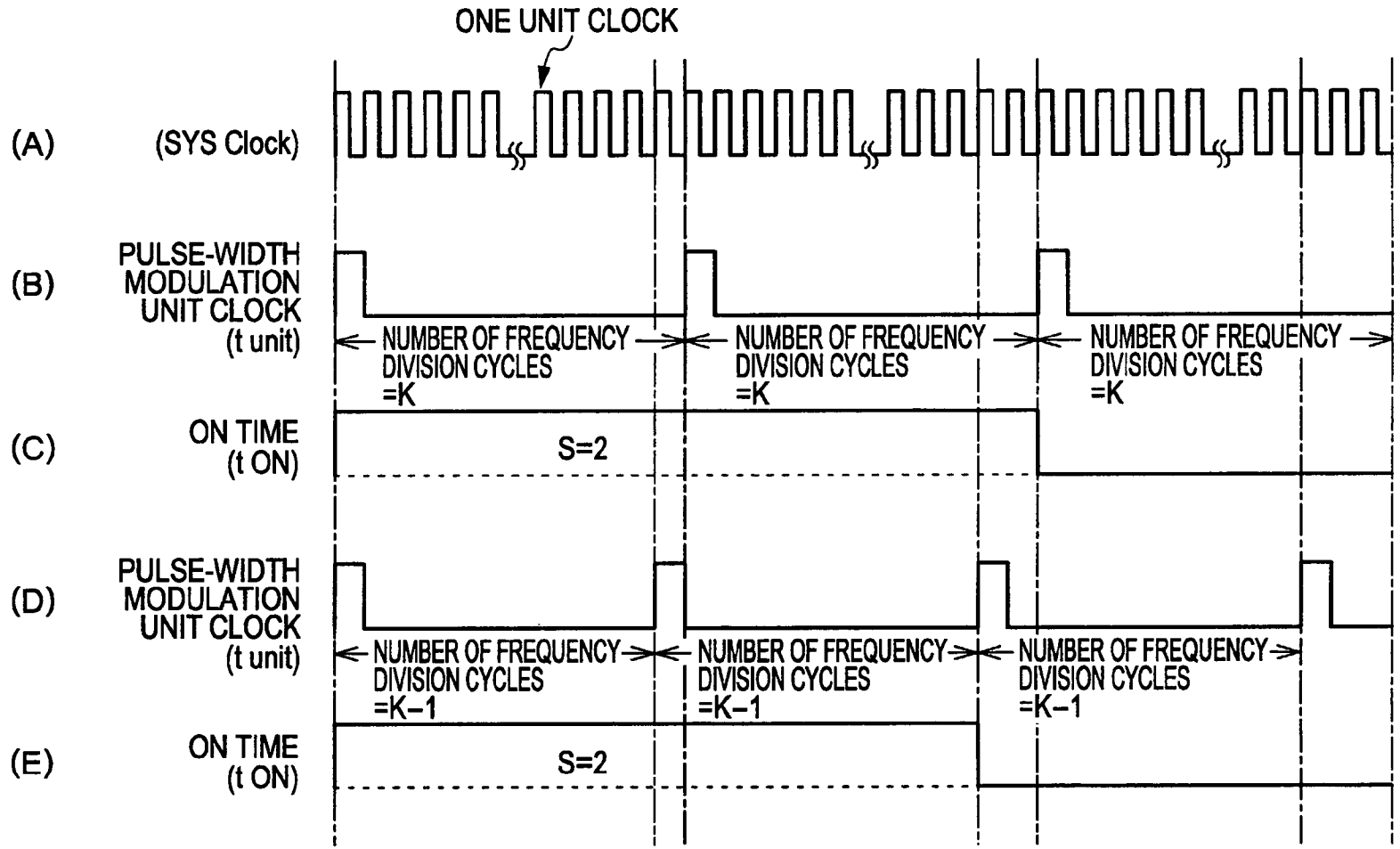
In FIG. 1, (A) schematically shows a waveform of a system clock; (B) and (D) schematically show a frequency division state of the system clock; and (C) and (E) schematically show ON time $t_{ON}$ when S=2.

In each planar light source unit driving circuit 80, the oscillator 83 serving as a system clock constantly operates (see a schematic waveform of the system clock shown in (A) in FIG. 1). Pulse-width modulation unit clocks $CL_{R\text{-}unit\text{-}(q,p)}$, $CL_{G\text{-}unit\text{-}(q,p)}$, and $CL_{B\text{-}unit\text{-}(q,p)}$ in the pulse-width modulation for ON/OFF control of the red LED $\mathbf{41}R_{(q,p)}$, the green LED $\mathbf{41}G_{(q,p)}$, and the blue LED $\mathbf{41}B_{(q,p)}$ constituting each planar light source unit $\mathbf{42}_{(q,p)}$ are obtained by the oscillator 83 and the frequency divider 84 under control by the operating circuit 81. The number of frequency division cycles of the system clock is "K". That is, the number of frequency division cycles of the system clock is K times the "one unit clock". A waveform in this state is schematically shown in (B) in FIG. 1. In (B) in FIG. 1, only the pulse-width modulation unit clock $CL_{R\text{-}unit\text{-}(q,p)}$ is shown as "$CL_{unit}$".

In the planar light source unit $\mathbf{42}_{(q,p)}$, a luminance value $Y'_{R\text{-}(q,p)}$ of the red LED $\mathbf{41}R_{(q,p)}$, a luminance value $Y'_{G\text{-}(q,p)}$ of the green LED $\mathbf{41}G_{(q,p)}$, and a luminance value $Y'_{B\text{-}(q,p)}$ of the blue LED $\mathbf{41}B_{(q,p)}$ that are measured by the photodiodes $\mathbf{44}R_{(q,p)}$, $\mathbf{44}G_{(q,p)}$, and $\mathbf{44}B_{(q,p)}$ in a previous frame are analog/digital-converted by the photodiode control circuit 86. Then, the operating circuit 81 determines whether a difference exists between the converted digital luminance values and an estimated luminance value $Y''_{R\text{-}(q,p)}$ of the red LED $\mathbf{41}R_{(q,p)}$, an estimated luminance value $Y''_{G\text{-}(q,p)}$ of the green LED $\mathbf{41}G_{(q,p)}$, and an estimated luminance value $Y'_{B\text{-}(q,p)}$ of the blue LED $\mathbf{41}B_{(q,p)}$ based on the values $S_{R\text{-}(q,p)}$, $S_{G\text{-}(q,p)}$, and $S_{B\text{-}(q,p)}$ of the pulse-width modulation output signals in the previous frame. A threshold of the difference between the luminance values may be predetermined and stored in the storage device 82.

If the operating circuit 81 determines that no difference exists therebetween, the values $CL_{R\text{-}unit\text{-}(q,p)}$, $CL_{G\text{-}unit\text{-}(q,p)}$, and $CL_{B\text{-}unit\text{-}(q,p)}$ are not changed. Then, the operating circuit 81 determines ON time $t_{R\text{-}ON\text{-}(q,p)}$, ON time $t_{G\text{-}ON\text{-}(q,p)}$, and ON time $t_{B\text{-}ON\text{-}(q,p)}$ of the red LED $41R_{(q,p)}$, the green LED $41G_{(q,p)}$, and the blue LED $41B_{(q,p)}$ constituting the planar light source unit $42_{(q,p)}$ on the basis of the values $S_{R\text{-}(q,p)}$, $S_{G\text{-}(q,p)}$, and $S_{B\text{-}(q,p)}$ of the pulse-width modulation output signals in this frame by using the following expressions. Note that $S_{R\text{-}(q,p)}=S_{G\text{-}(q,p)}=S_{B\text{-}(q,p)}=S$ in the first embodiment.

$$t_{R\text{-}ON\text{-}(q,p)}=CL_{R\text{-}unit\text{-}(q,p)}\times S_{R\text{-}(q,p)} \quad (1\text{-}1')$$

$$t_{G\text{-}ON\text{-}(q,p)}=CL_{G\text{-}unit\text{-}(q,p)}\times S_{G\text{-}(q,p)} \quad (1\text{-}2')$$

$$t_{B\text{-}ON\text{-}(q,p)}=CL_{B\text{-}unit\text{-}(q,p)}\times S_{B\text{-}(q,p)} \quad (1\text{-}3')$$

The ON-time $t_{R\text{-}ON\text{-}(q,p)}$ when $S_{R\text{-}(q,p)}=2$ is schematically shown in (C) in FIG. 1. In (C) in FIG. 1, $S_{R\text{-}(q,p)}$ is represented by "S" and $t_{R\text{-}ON\text{-}(q,p)}$ is represented by "$t_{ON}$".

On the other hand, if the operating circuit 81 determines that a difference exists between the luminance value $Y'_{R\text{-}(q,p)}$ of the red LED $41R_{(q,p)}$ measured by the photodiode $44R_{(q,p)}$ in the previous frame and the estimated luminance value $Y''_{R\text{-}(q,p)}$ of the red LED $41R_{(q,p)}$ based on the value $S_{R\text{-}(q,p)}$ of the pulse-width modulation output signal in the previous frame, the pulse-width modulation unit clock $CL_{R\text{-}Unit}$ is adjusted to long or short by increasing or decreasing the number of frequency division cycles of the system clock in the driving circuit (in other words, in the pulse-width modulation). More specifically, if the luminance value $Y'_{R\text{-}(q,p)}$ of the red LED $41R_{(q,p)}$ measured by the photodiode $44R_{(q,p)}$ in the previous frame is larger than the estimated luminance value $Y''_{R\text{-}(q,p)}$ of the red LED $41R_{(q,p)}$ based on the value $S_{R\text{-}(q,p)}$ of the pulse-width modulation output signal in the previous frame, the pulse-width modulation unit clock $C_{LR\text{-}Unit}$ is shortened by decreasing the number of frequency division cycles of the system clock (e.g., the number of cycles is decreased by one unit clock to "K−1"). (D) and (E) in FIG. 1 schematically show this state. In (D) and (E) in FIG. 1, the pulse-width modulation unit clock $CL_{R\text{-}unit\text{-}(q,p)}$ is represented by "$CL_{unit}$", $S_{R\text{-}(q,p)}$ is represented by "S", and $t_{R\text{-}ON\text{-}(q,p)}$ is represented by "$t_{ON}$". On the other hand, if the luminance value $Y'_{R\text{-}(q,p)}$ of the red LED $41R_{(q,p)}$ measured by the photodiode $44R_{(q,p)}$ in the previous frame is smaller than the estimated luminance value $Y''_{R\text{-}(q,p)}$ of the red LED $41R_{(q,p)}$ based on the value $S_{R\text{-}(q,p)}$ of the pulse-width modulation output signal in the previous frame, the pulse-width modulation unit clock $CL_{R\text{-}unit}$ is made long by increasing the number of frequency division cycles of the system clock (e.g., the number of cycles is increased by one unit clock to "K+1"). The increase or decrease of the number of frequency division cycles of the system clock is not limited to one unit clock. For example, the number of frequency division cycles of the system clock may be increased or decreased by k unit clocks (k=1, 2, 3 . . . ) in accordance with a difference between the luminance value Y' of the red LED 41 measured by the photodiode 44 in the previous frame and the estimated luminance value Y" of the LED 41 based on the value S of the pulse-width modulation output signal in the previous frame.

When OFF times of the red LED $41R_{(q,p)}$, the green LED $41G_{(q,p)}$, and the blue LED $41B_{(q,p)}$ are $t_{R\text{-}OFF\text{-}(q,p)}$, $t_{G\text{-}OFF\text{-}(q,p)}$, and $t_{B\text{-}OFF\text{-}(q,p)}$, $t_{R\text{-}ON\text{-}(q,p)}+t_{R\text{-}OFF\text{-}(q,p)}=t_{G\text{-}ON\text{-}(q,p)}+t_{G\text{-}OFF\text{-}(q,p)}=t_{B\text{-}ON\text{-}(q,p)}+t_{B\text{-}OFF\text{-}(q,p)}$=constant value $t_{Const}$.

For example, assume that the system clock is 100 MHz (=$10^8$ Hz) and that the driving frequency of the LED is 600 Hz, the value of the pulse-width modulation unit clock $CL_{unit}$ is $10^8/(600\times256)\approx650$, that is, about 650 times one unit clock. Thus, a change of one unit clock in the number of frequency division cycles of the system clock is (1/650)=0.15%. That is, ON times $t_{R\text{-}ON}$, $t_{G\text{-}ON}$, and $t_{B\text{-}ON}$ of the LEDs can be controlled on about 0.15% basis. This value is an example, and the present invention is not limited to this value.

Figure 2:
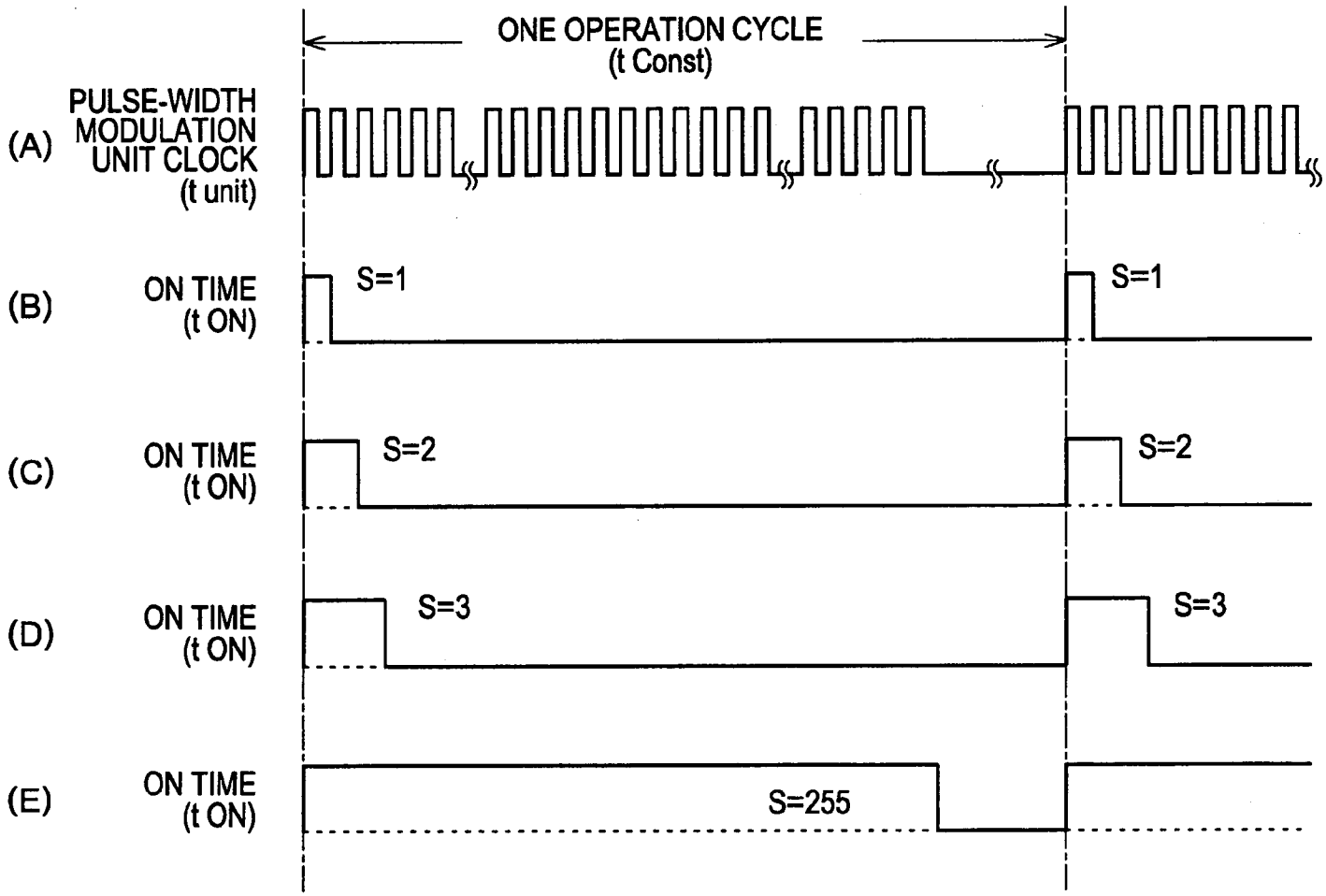
In FIG. 2, (A) schematically shows a pulse-width modulation unit clock ($CL_{unit}$); and (B), (C), (D), and (E) schematically show ON time $t_{ON}$ when S=1, 2, 3, and 255 (maximum), respectively.

(A) in FIG. 2 schematically shows the pulse-width modulation unit clock ($CL_{unit}$). (B), (C), (D), and (E) in FIG. 2 schematically show ON times $t_{ON}$ in cases where S=1, 2, 3, and 255 (maximum). The constant value $t_{Const}$ corresponding to one operation cycle and the maximum ON time $t_{ON\text{-}max}$ have a relationship of $t_{ON\text{-}max}<t_{Const}$.

Figure 7A:
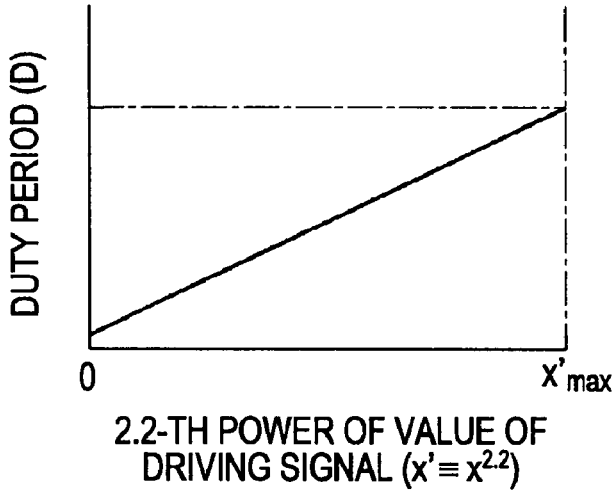
FIG. 7A schematically shows a relationship between 2.2-th power of a value of a driving signal input to the color LCD device driving circuit in order to drive sub-pixels ($x' \equiv x^{2.2}$) and a duty period ($=t_{ON}/t_{Const}$)
Figure 7B:
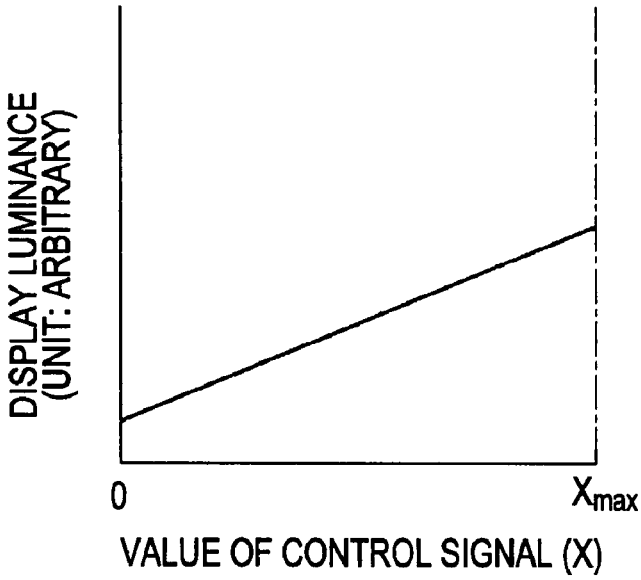
FIG. 7B schematically shows a relationship between a value X of a control signal to control light transmittance of sub-pixels and display luminance y.

The signals corresponding to the ON times $t_{R\text{-}ON\text{-}(q,p)}$, $t_{G\text{-}ON\text{-}(q,p)}$, and $t_{B\text{-}ON\text{-}(q,p)}$ of the red LED $41R_{(q,p)}$, the green LED $41G_{(q,p)}$, and the blue LED $41B_{(q,p)}$ constituting the planar light source unit $42_{(q,p)}$ obtained in this way are transmitted to the LED driving circuit 85. On the basis of the values of the signals corresponding to the ON times $t_{R\text{-}ON\text{-}(q,p)}$, $t_{G\text{-}ON\text{-}(q,p)}$, and $t_{B\text{-}ON\text{-}(q,p)}$, the switching elements 87R, 87G, and 87B are in an ON-state during the ON times $t_{R\text{-}ON\text{-}(q,p)}$, $t_{G\text{-}ON\text{-}(q,p)}$, and $t_{B\text{-}ON\text{-}(q,p)}$, and LED driving current from the LED driving power supply 88 is supplied to each of the LEDs $41R_{(q,p)}$, $41G_{(q,p)}$, and $41B_{(q,p)}$. As a result, the LEDs $41R_{(q,p)}$, $41G_{(q,p)}$, and $41B_{(q,p)}$ emit light during the ON times $t_{R\text{-}ON\text{-}(q,p)}$, $t_{G\text{-}ON\text{-}(q,p)}$, and $t_{B\text{-}ON\text{-}(q,p)}$, respectively, in one frame period. Accordingly, the (q, p)-th display area unit $12_{(q,p)}$ is lighted at predetermined illuminance. A state of the display luminance obtained in the above-described manner is shown by solid lines in FIGS. 7A and 7B. FIG. 7A schematically shows a relationship between 2.2-th power of a value of a driving signal input to the color LCD device driving circuit in order to drive sub-pixels ($x'=x^{2.2}$) and a duty period ($=t_{ON}/t_{Const}$). FIG. 7B schematically shows a relationship between a value X of a control signal to control the light transmittance of the sub-pixels and the display luminance y.

On the other hand, the values $x_{r\text{-}(q,p/n,m)}$, $x_{G\text{-}(q,p/n,m)}$, and $x_{B\text{-}(q,p/n,m)}$ of the driving signals $[R, G, B]_{(q,p/n,m)}$ input to the color LCD device driving circuit 90 are transmitted to the timing controller 91. The timing controller 91 supplies (outputs) control signals $[R, G, B]_{(q,p/n,m)}$ corresponding to the input driving signals $[R, G, B]_{(q,p/n,m)}$ to the sub-pixels $[R, G, B]_{(q,p/n,m)}$. The values $X_{R\text{-}(q,p/n,m)}$, $X_{G\text{-}(q,p/n,m)}$, and $X_{B\text{-}(q,p/n,m)}$ of the control signals $[R, G, B]_{(q,p/n,m)}$, which are generated in the timing controller 91 of the color LCD device driving circuit 90 and which are supplied from the color LCD device driving circuit 90 to the sub-pixels $[R, G, B]_{(q,p/n,m)}$, and the values $x_{R\text{-}(q,p/n,m)}$, $x_{G\text{-}(q,p/n,m)}$, and $x_{B\text{-}(q,p/n,m)}$ of the driving signals $[R, G, B]_{(q,p/n,m)}$ are in the following relationship. Note that $b_{1_R}$, $b_{0_R}$, $b_{1_G}$, $b_{0_G}$, $b_{1_B}$, and $b_{0_B}$ are constants. On the basis of the values $X_{R\text{-}(q,p/n,m)}$, $X_{G\text{-}(q,p/n,m)}$, and $X_{B\text{-}(q,p/n,m)}$ of the control signals $[R, G, B]_{(q,p/n,m)}$, the light transmittance (aperture ratio) Lt of the liquid crystal cells constituting the sub-pixels $[R, G, B]_{(q,p/n,m)}$ is controlled.

$$X_{R\text{-}(q,p/n,m)}=b_{1_R}\cdot x_{R\text{-}(q,p/n,m)}^{2.2}+b_{0_R} \quad (3\text{-}1)$$

$$X_{G\text{-}(q,p/n,m)}=b_{1_G}\cdot x_{G\text{-}(q,p/n,m)}^{2.2}+b_{0_G} \quad (3\text{-}2)$$

$$X_{B\text{-}(q,p/n,m)}=b_{1_B}\cdot x_{B\text{-}(q,p/n,m)}^{2.2}+b_{0_B} \quad (3\text{-}3)$$

In this way, an image of one frame is displayed. In one frame, an operation of the color LCD device 10 is synchronized with an operation of the planar light source device 40 on the basis of the clock signal CLK.

The embodiment of the present invention has been described above, but the present invention is not limited to this embodiment. The configurations of the transmissive color LCD device, the planar light source device, and the color LCD device assembly described in the embodiment are examples. Also, the components and materials constituting those devices are examples and can be adequately modified. Alternatively, temperature of the LEDs may be monitored by a temperature sensor and the result may be fed back to the planar light source unit driving circuit 80, so that the luminance of the planar light source units may be compensated (corrected) or the temperature thereof can be controlled.

Figure 8:
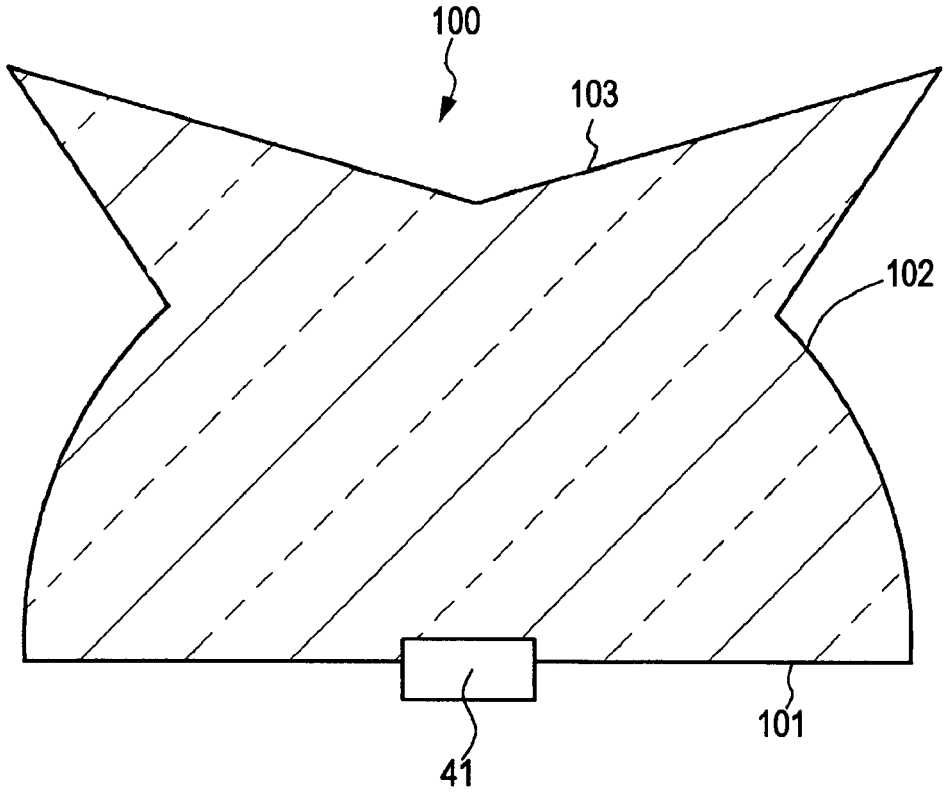
FIG. 8 is a schematic cross-sectional view of a light extracting lens disclosed in p. 128, vol. 889 of Nikkei Electronics published on Dec. 20, 2004.

As shown in a conceptual view in FIG. 8, an LED assembly including an LED 41 attached with a light extracting lens 100 may be used as a light source, light emitted from the LED 41 may be totally reflected on a top surface 103 of the light extracting lens 100, and the light may be output mainly in the horizontal direction of the light extracting lens 100 in a two-dimensional direction output configuration. In FIG. 8, reference numeral 101 denotes a bottom surface of the light extracting lens 100, and reference numeral 102 denotes a side surface of the light extracting lens 100. As the material of the light extracting lens, material used for an eyeglass lens can be used. For example, plastic material having a high refractive index can be used. The examples include "Prestige" (refractive index: 1.74) made by Seiko Optical Products Co., Ltd.; "ULTIMAX V AS 1.74" (refractive index: 1.74) made by SHOWA OPT. Co., Ltd.; and "NL5-AS" (refractive index: 1.74) made by Nikon-Essilor Co., Ltd. Also, optical glass such as glass material "NBFD11" (refractive index $n_1$: 1.78), "M-NBFD82" (refractive index $n_1$: 1.81), and M-LAF81 (refractive index $n_1$: 1.731) made by HOYA Corporation; and inorganic dielectric material such as $KTiOPO_4$ (refractive index $n_1$: 1.78) and lithium niobate ($LiNbO_3$) (refractive index: $n_1$: 2.23) can be used.

It should be understood by those skilled in the art that various modifications, combinations, sub-combinations and alterations may occur depending on design requirements and other factors insofar as they are within the scope of the appended claims or the equivalents thereof.

What is claimed is:

1. A method for driving a planar light source device, the planar light source device including a plurality of planar light source units to light a color LCD device from the back, each planar light source unit including a red LED, a green LED, and a blue LED; and a driving circuit to perform ON/OFF control of the red LED, the green LED, and the blue LED included in each planar light source unit on the basis of pulse-width modulation, and wherein, when pulse-width modulation unit clocks in the pulse-width modulation for ON/OFF control of the red, green, and blue LEDs included in each planar light source unit are $CL_{R\text{-}unit}$, $CL_{G\text{-}unit}$, and $CL_{B\text{-}unit}$; when ON time of the red LED in each planar light source unit is $t_{R\text{-}ON}$; when OFF time of the red LED is $t_{R\text{-}OFF}$; when a value of a pulse-width modulation output signal to control light emission time of the red LED is $S_R$; when ON time of the green LED is $t_{G\text{-}ON}$; when OFF time of the green LED is $t_{G\text{-}OFF}$; when a value of a pulse-width modulation output signal to control light emission time of the green LED is $S_G$; when ON time of the blue LED is $t_{B\text{-}ON}$; when OFF time of the blue LED is $t_{B\text{-}OFF}$; and when a value of a pulse-width modulation output signal to control light emission time of the blue LED is $S_B$, equations $$t_{R\text{-}ON}+t_{R\text{-}OFF}=t_{G\text{-}ON}+t_{G\text{-}OFF}=t_{B\text{-}ON\text{-}OFF}=\text{constant value } t_{Const};$$

$$t_{R\text{-}ON}=CL_{R\text{-}unit}\times S_R;$$

$$t_{G\text{-}ON}=CL_{G\text{-}unit}\times S_G; \text{ and}$$

$$t_{B\text{-}ON}=CL_{B\text{-}unit}\times S_B \text{ are satisfied,}$$

the method comprising the step of:

adjusting a pulse duration of each of the pulse-width modulation unit clock $CL_{R\text{-}unit}$, the pulse-width modulation unit clock $CL_{G\text{-}unit}$, and the pulse-width modulation unit clock $CL_{B\text{-}unit}$ by adjusting a number of frequency division cycles of a system clock in the driving circuit that corresponds to the pulse duration of the respective pulse-width modulation unit clocks $CL_{R\text{-}unit}$, $CL_{G\text{-}unit}$, and $CL_{B\text{-}unit}$ in each planar light source unit, wherein the adjusting comprises increasing or decreasing the number of the frequency division cycles by at least one unit clock, based on a difference between luminance of each of the red LED, the green LED and the blue LED measured in a previous frame and respective estimated luminance of each of the red LED, the green LED and the blue LED calculated based on respective values of $S_R$, $S_G$ and $S_B$ in the previous frame.

2. The method for driving the planar light source device according to claim 1, wherein, when maximum ON time of the red LED is $t_{R\text{-}ON\text{-}max}$; when maximum ON time of the green LED is $t_{G\text{-}ON\text{-}max}$; and when maximum ON time of the blue LED is $t_{B\text{-}ON\text{-}max}$, inequalities $$t_{R\text{-}ON\text{-}max}<t_{Const};$$

$$t_{G\text{-}ON\text{-}max}<t_{Const}; \text{ and}$$

$$t_{B\text{-}ON\text{-}max}<t_{Const} \text{ are satisfied.}$$

3. The method for driving the planar light source device according to claim 1, further comprising measuring the luminance of each of the red, green, and blue LEDs included in each planar light source unit.

4. A method for driving a color LCD device assembly, the color LCD device assembly including a color LCD device including a display area having P×Q display area units, the display area including pixels arranged in a two-dimensional matrix pattern and each of the display area units including a plurality of pixels;

a planar light source device including P×Q planar light source units corresponding to the P×Q display area units and a driving circuit to drive the planar light source units, each planar light source unit including a red LED, a green LED, and a blue LED, and lighting the corresponding display area unit from the back; and a color LCD device driving circuit to drive the color LCD device, wherein, when pulse-width modulation unit clocks in pulse-width modulation for ON/OFF control of the red, green, and blue LEDs included in each planar light source unit are $CL_{R\text{-}unit}$, $CL_{G\text{-}unit}$, and $CL_{B\text{-}unit}$; when ON time of the red LED in each planar light source unit is $t_{R\text{-}ON}$; when OFF time of the red LED is $t_{R\text{-}OFF}$; when a value of a pulse-width modulation output signal to control light emission time of the red LED is $S_R$; when ON time of the green LED is $t_{G\text{-}ON}$; when OFF time of the green LED is $t_{G\text{-}OFF}$; when a value of a pulse-width modulation output signal to control light emission time of the green LED is $S_G$; when ON time of the blue LED is $t_{B\text{-}ON}$; when OFF time of the blue LED is $t_{B\text{-}OFF}$; and when a value of a pulse-width modulation output signal to control light emission time of the blue LED is $S_B$, equations $t_{R\text{-}ON}+t_{R\text{-}OFF}=t_{G\text{-}ON}+t_{G\text{-}OFF}=t_{B\text{-}ON}+t_{B\text{-}OFF}$=constant value $t_{Const}$;

$t_{R\text{-}ON}=CL_{R\text{-}unit}\times S_R$;

$t_{G\text{-}ON}=CL_{G\text{-}unit}\times S_G$; and $t_{B\text{-}ON}=CL_{B\text{-}unit}\times S_B$ are satisfied, the method comprising the step of:

adjusting a pulse duration of each of the pulse-width modulation unit clock $CL_{R\text{-}unit}$, the pulse-width modulation unit clock $CL_{G\text{-}unit}$, and the pulse-width modulation unit clock $CL_{B\text{-}unit}$ by adjusting a number of frequency division cycles of a system clock in the driving circuit that corresponds to the pulse duration of the respective pulse-width modulation unit clocks $CL_{R\text{-}unit}$, $CL_{G\text{-}unit}$, and $CL_{B\text{-}unit}$ in each planar light source unit, wherein the adjusting comprises increasing or decreasing the number of the frequency division cycles by at least one unit clock, and wherein, when luminance of the red LED measured in a previous frame is larger than estimated luminance of the red LED measured based on a value of the pulse-width modulation output signal to control light emission time of the red LED in the previous frame, the pulse duration of the pulse-width modulation unit clock $CL_{R\text{-}unit}$ is shortened by decreasing the number of the frequency division cycles by the at least one unit clock.

5. A method for driving an LED, a driving circuit to perform ON/OFF control of the LED on the basis of pulse-width modulation being used, wherein, when a pulse-width modulation unit clock in the pulse-width modulation for ON/OFF control of the LED is $CL_{unit}$; when ON time of the LED is $t_{ON}$; when OFF time of the LED is $t_{OFF}$; and when a value of a pulse-width modulation output signal to control light emission time of the LED is S, equations $t_{ON}+t_{OFF}$ =constant value $t_{const}$; and $t_{ON}=CL_{unit}\times S$ are satisfied, the method comprising the step of:

adjusting a pulse duration of the pulse-width modulation unit clock $CL_{unit}$ by adjusting a number of frequency division cycles of a system clock in the driving circuit that corresponds to the pulse duration of the pulse-width modulation unit clock $CL_{unit}$, wherein the adjusting comprises increasing or decreasing the number of the frequency division cycles by at least one unit clock, based on a difference between luminance of the LCD measured in a previous frame and estimated luminance of the LCD calculated based on a value of the pulse-width modulation output signal in the previous frame.

6. The method for driving the LED according to claim 5, wherein, when maximum ON time of the LED is $t_{ON\text{-}max}$, $t_{ON\text{-}max}<t_{const}$ is satisfied.

7. The method for driving the LED according to claim 5, further comprising measuring the luminance of the LED.

8. A pulse-width modulating method for a liquid crystal display (LCD) device, wherein, when a pulse-width modulation unit clock in pulse-width modulation is $CL_{unit}$; when ON time is $t_{ON}$; when OFF time is $t_{OFF}$; and when a value of a pulse-width modulation output signal is S, equations $t_{ON}+t_{OFF}$ =constant value $t_{Const, and}$ $t_{ON}=CL_{unit}\times S$ are satisfied, the method comprising the step of:

adjusting a pulse duration of the pulse-width modulation unit clock $CL_{unit}$ by adjusting a number of frequency division cycles of a system clock that corresponds to the pulse duration of the pulse-width modulation unit clock $CL_{unit}$ by at least one unit clock, based on a difference between luminance of the LCD measured in a previous frame and estimated luminance of the LCD calculated based on a value of the pulse-width modulation output signal in the previous frame.

* * * * *